US012250965B2

(12) United States Patent
Wahidi

(10) Patent No.: US 12,250,965 B2
(45) Date of Patent: Mar. 18, 2025

(54) SMOKABLE INSERT SYSTEM INCLUDING FLAVOR RELEASING MECHANISM HELD BY A LOWER PARTITION

(71) Applicant: AIDEMAR GROUP, INC., Vernon, CA (US)

(72) Inventor: Jawid Wahidi, Irvine, CA (US)

(73) Assignee: Aidemar Group, Inc., Vernon, CA (US)

( * ) Notice: Subject to any disclaimer, the term of this patent is extended or adjusted under 35 U.S.C. 154(b) by 0 days.

(21) Appl. No.: 18/137,410

(22) Filed: Apr. 20, 2023

(65) Prior Publication Data

US 2024/0130421 A1 Apr. 25, 2024
US 2024/0225089 A9 Jul. 11, 2024

Related U.S. Application Data

(60) Provisional application No. 63/417,384, filed on Oct. 19, 2022.

(51) Int. Cl.

*A24D 3/06* (2006.01)
*A24D 3/02* (2006.01)
*A24D 3/04* (2006.01)
*A24D 3/18* (2006.01)

(52) U.S. Cl.

CPC ..... *A24D 3/061* (2013.01); *A24D 3/0266* (2013.01); *A24D 3/0275* (2013.01); *A24D 3/048* (2013.01); *A24D 3/18* (2013.01)

(58) Field of Classification Search

CPC ..... A24D 1/022; A24D 1/002; A24D 3/061; A24C 5/46; A24C 5/42

See application file for complete search history.

(56) References Cited

U.S. PATENT DOCUMENTS

| | | | | |
|---|---|---|---|---|
| 3,370,594 | A * | 2/1968 | Haslam | A24D 3/045 131/210 |
| 5,657,773 | A * | 8/1997 | George | A24C 5/40 131/365 |
| 11,369,137 | B1 * | 6/2022 | Wahidi | A24D 3/185 |
| 2004/0261807 | A1 * | 12/2004 | Dube | A24D 3/14 131/331 |
| 2011/0232659 | A1 * | 9/2011 | Ercelebi | A24D 3/061 29/458 |
| 2012/0138075 | A1 * | 6/2012 | Jespersen | A24D 3/02 131/331 |
| 2018/0077964 | A1 * | 3/2018 | Farmer | A24D 1/022 |

* cited by examiner

*Primary Examiner* — Michael H. Wilson
*Assistant Examiner* — Stephanie Lynn Moore
(74) *Attorney, Agent, or Firm* — Cohen IP Law Group, PC; Michael N. Cohen

(57) ABSTRACT

An insert system for use with a smokable (e.g., such as a pre-rolled or empty cone) including an internal partition that extends from the insert system's first end to an intermediate location between the insert system's first and its second end. A flavor releasing mechanism (e.g., a flavor ball) is located within the insert system between the intermediate location and the system's second end. Accordingly, the internal partition obstructs the flavor releasing mechanism from passing through the system's first end. The system's second end includes an obstructor (e.g., a perforated cap) thereby obstructing the flavor releasing mechanism from passing through the system's second end. The insert system may then be coupled with a smokable item to serve as the item's mouthpiece.

11 Claims, 32 Drawing Sheets

SMOKABLE INSERT SYSTEM INCLUDING FLAVOR RELEASING MECHANISM HELD BY A LOWER PARTITION

CROSS-REFERENCE TO RELATED APPLICATIONS

This application claims priority to U.S. Provisional Application No. 63/417,384 filed Oct. 19, 2022, the entire contents of which are hereby fully incorporated herein by reference for all purposes.

FIELD OF THE INVENTION

The present invention relates to smokable pre-rolls, including smokable pre-rolls with embedded flavor releasing mechanisms.

BACKGROUND

Ready-to-smoke smokables come in many forms and shapes, ranging from cigarettes to pre-rolls (e.g., pre-rolled cones as shown in FIG. 1). For those who wish to form his/her own smokable, empty cones are available into which the user adds his/her own smokable materials. In either case, the smokable oftentimes includes an insert system (such as a filter or crutch) that serves as a mouthpiece at one end of the smokable.

A new phenomenon is happening within the smokables industry involving the inclusion of flavor releasing mechanisms within the smokable insert system. In many cases, the flavor releasing mechanisms include small spheres filled with a flavoring substance (also known as "flavor balls") that are designed to be squeezed by the user to effectively explode and release the flavoring. However, it is difficult and oftentimes costly and labor intensive to place and secure the flavor releasing mechanism properly within the insert during the manufacturing process. In addition, if the flavor releasing mechanisms are not properly held within the insert, the flavoring released may leak and/or not provide adequate flavoring.

Accordingly, there is a need for an insert system that performs well and that includes an easy-to-use system and method to incorporate one or more flavor releasing mechanisms into a smokable insert to maximize the user's smoking experience.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

For the purposes of this specification, the terms below will mean the following.

Cigarette generally refers to a smokable comprising a thin cylinder of finely cut tobacco, *cannabis*, other types of leaves, flowers, herbs, and/or other smokable materials, rolled in a suitable paper for smoking.

Figure 1:
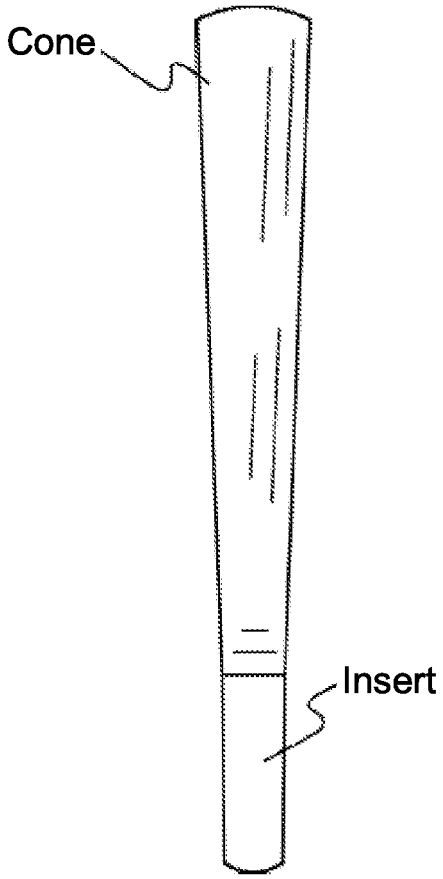
FIG. 1 shows aspects of a smokable cone.

Cone generally refers to a conical- or frustum-shaped cigarette (or "joint") wherein the shape flares from a smaller diameter proximal base to a larger diameter distal tip (see FIG. 1). Cones may typically comprise paper, hemp, palm leaves, rice, cotton cellulose, glycerin, and/or other suitable materials.

Pre-roll generally refers to a cigarette or cone that has been formed prior to its sale and is therefore consumer-ready (i.e., a consumer is not required to fill or otherwise form the smokable).

Empty cone refers to an empty cone into which a consumer may place smokable materials (e.g., tobacco, *cannabis*, etc.) to form a smokable cone.

Insert system generally refers to a mouthpiece or tip coupled with a cone or cigarette (see FIG. 1) that acts to support the proximal end of the smokable (e.g., the end that is pressed against one's lips for smoking). An insert system may include a "crutch" formed of thick paper, glass or other materials, a filter (e.g., a cotton filter), other types of insert systems, and any combinations thereof. Insert systems may be used with cigarettes, cones (pre-rolled, empty, etc.), rolling papers, and other types of smokable items.

In general, and according to exemplary embodiments hereof, an insert system 10 including internal obstructors (e.g., upper and/or lower) for securing flavor releasing mechanisms (e.g., flavored "click balls") within a flavor mechanism holder and for use with a smokable item (e.g., a pre-roll cone, an empty cone, a pre-rolled or hand-rolled cigarette, etc.) is provided. In some embodiments, the insert system 10 including an internal flavor releasing mechanism is provided as a standalone item for use in pre-rolling and/or hand rolling a cone, cigarette, etc. In this case, flavor releasing mechanisms may be inserted into the insert system's internal compartment and the insert system 10 may be coupled with the proximal end of a rolling paper or cone to form the smokable item. In other embodiments, the insert system 10 includes (e.g., is coupled with) an empty cone and is provided to the consumer. In this case, it may be preferable that the insert system 10 include flavor releasing mechanisms already placed within the insert system's internal compartment and ready for use by the consumer. The consumer then may fill the empty cone with smokable materials to form a smokable cone wherein the insert system 10 is used as the cone's mouthpiece. It is understood that the insert system 10 may be used with any suitable smokable item in any suitable configuration and that the examples provided herein are not meant to be limiting.

Figure 2:
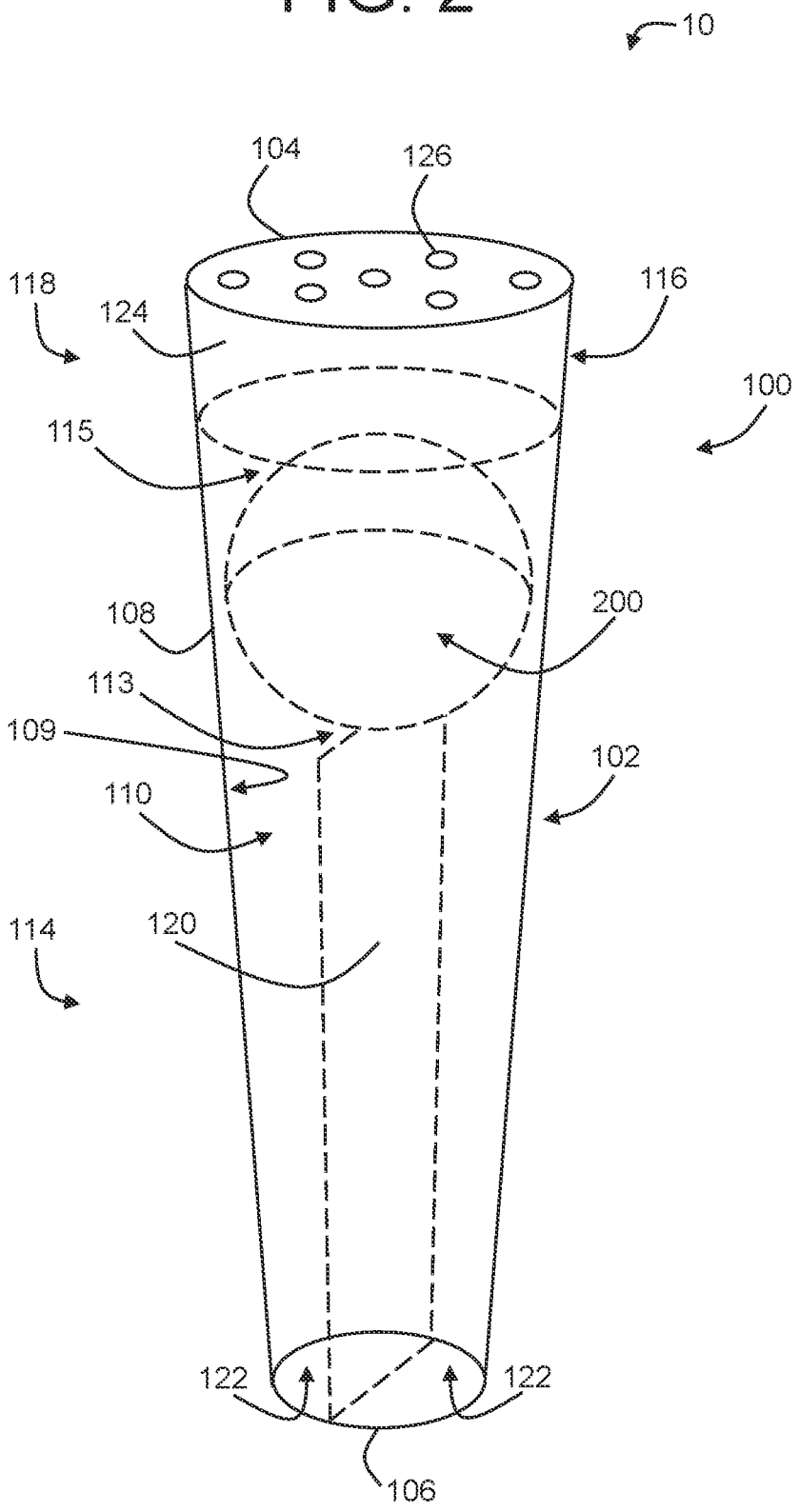
FIGS. 2-8 show aspects of an insert system according to exemplary embodiments hereof.

In one exemplary embodiment hereof as shown in FIG. 2, the insert system 10 includes a mouthpiece member 100 and one or more flavor releasing mechanisms 200 held within the mouthpiece member 100. The mouthpiece member 100 may be formed from a section of material 300 (e.g., paper, cardboard, plastic, etc.) as will be described herein in detail. The flavor releasing mechanism(s) 200 may include flavor balls filled with a flavoring substance and/or other types of flavor releasing mechanisms 200. The insert system 10 also may include other elements as necessary for the system 10 to perform its functionalities.

FIG. 2 shows a mouthpiece member 100 including a member body 102 including a first end 104 (e.g., a top end), a second end 106 (e.g., a bottom end), and sidewalls 108 extending between the first end 104 and the second end 106 thereby defining an inner volume 110. The sidewalls 108 include a sidewall inner surface 109 facing into the inner volume 110. As will be described in other sections, the flavor releasing mechanism(s) 200 are contained within the inner volume 110.

Figure 31:
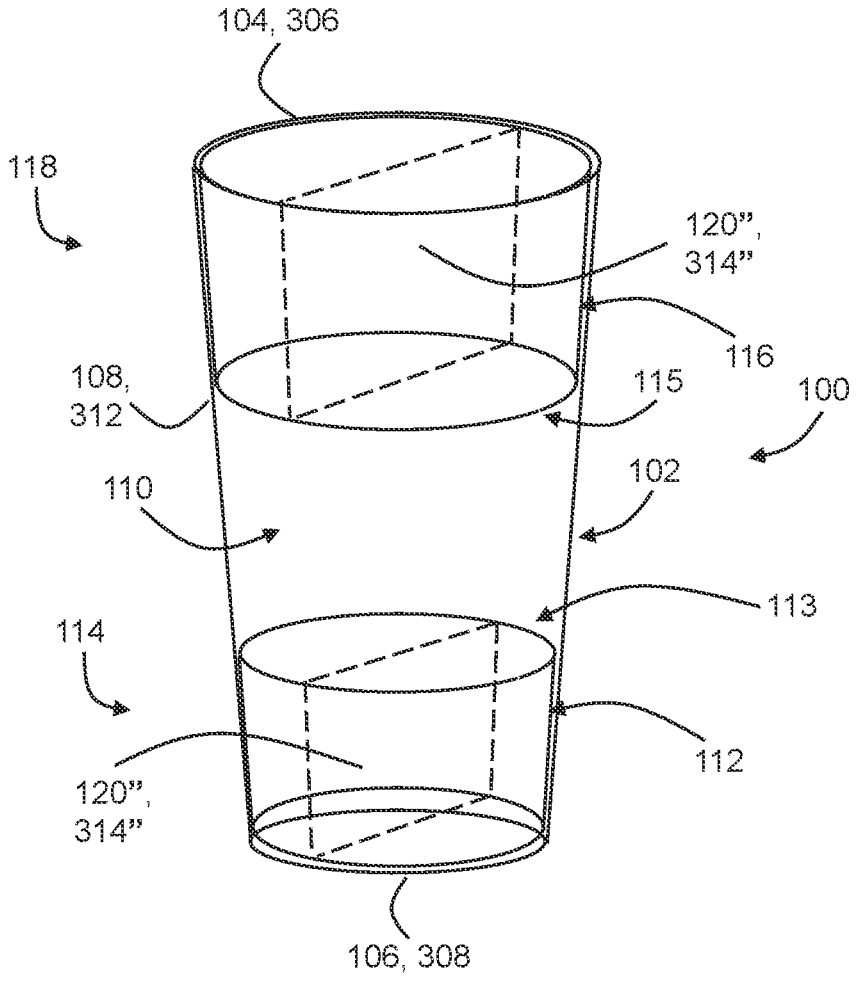
FIG. 31 shows aspects of an insert system according to exemplary embodiments hereof.

In some embodiments, the mouthpiece member 100 includes a first obstructor 112 within the inner volume 110 of the member body 102 and located generally in the lower portion 114 of the body 102 (also see FIG. 31). In some embodiments, the first obstructor 112 extends from the second end 106 (e.g., the bottom end) upward to a first intermediate location 113 within the inner volume 110. In some embodiments, the mouthpiece member 100 includes a second obstructor 116 within the inner volume 110 of the member body 102 and located generally in the upper portion 118 of the body 102. In some embodiments, the second obstructor 116 extends from the first end 104 (e.g., the top end) downward to a second intermediate location 115 within the inner volume 110.

As will be described herein, the flavor releasing mechanism 200 is located within the inner volume 110 between the first and second intermediate locations 113, 115 and is thereby held in place by the first and second obstructors 112, 116. Notably, the flavor releasing mechanism 200 of FIGS. 2-8 are represented as flavor balls 202 comprising a crushable spherical container with a flavoring substance inside. The flavor balls 202 may be adapted to generally burst (or otherwise open) when squeezed thereby releasing the flavoring substance. In this way, a user may squeeze a flavor ball 202 embedded within the insert system 10 when a flavoring is desired during the smoking experience. However, it is understood that other types of flavor releasing mechanisms 200 may be used as described in other sections or otherwise, and that the flavor releasing mechanisms 200 are not limited to flavor balls 202.

In some embodiments, the first obstructor 112 includes a partition 120. In some embodiments, the partition 120 extends across at least a portion of the inner volume 110 from generally opposing locations along the inner surface of the sidewalls 108. In some embodiments, it may be preferable that the partition 120 generally bisect the cross-section of the inner volume 110, but this may not be required. In some embodiments, as shown in FIG. 2, the partition 120 forms two adjacent longitudinal compartments 122 within the lower portion 114 of the inner volume 118. While the partition 120 of FIGS. 2-8 is generally shown as a single partition that extends across a portion of the inner volume 110, it also is contemplated that the partition 120 include other shaped partitions, for example, and without limitation, partitions with cross-sections shaped as an "X" or "+" (i.e., two partitions that bisect one another along their longitudinal lengths thereby forming a partition including an X-shaped cross section).

Figure 3:
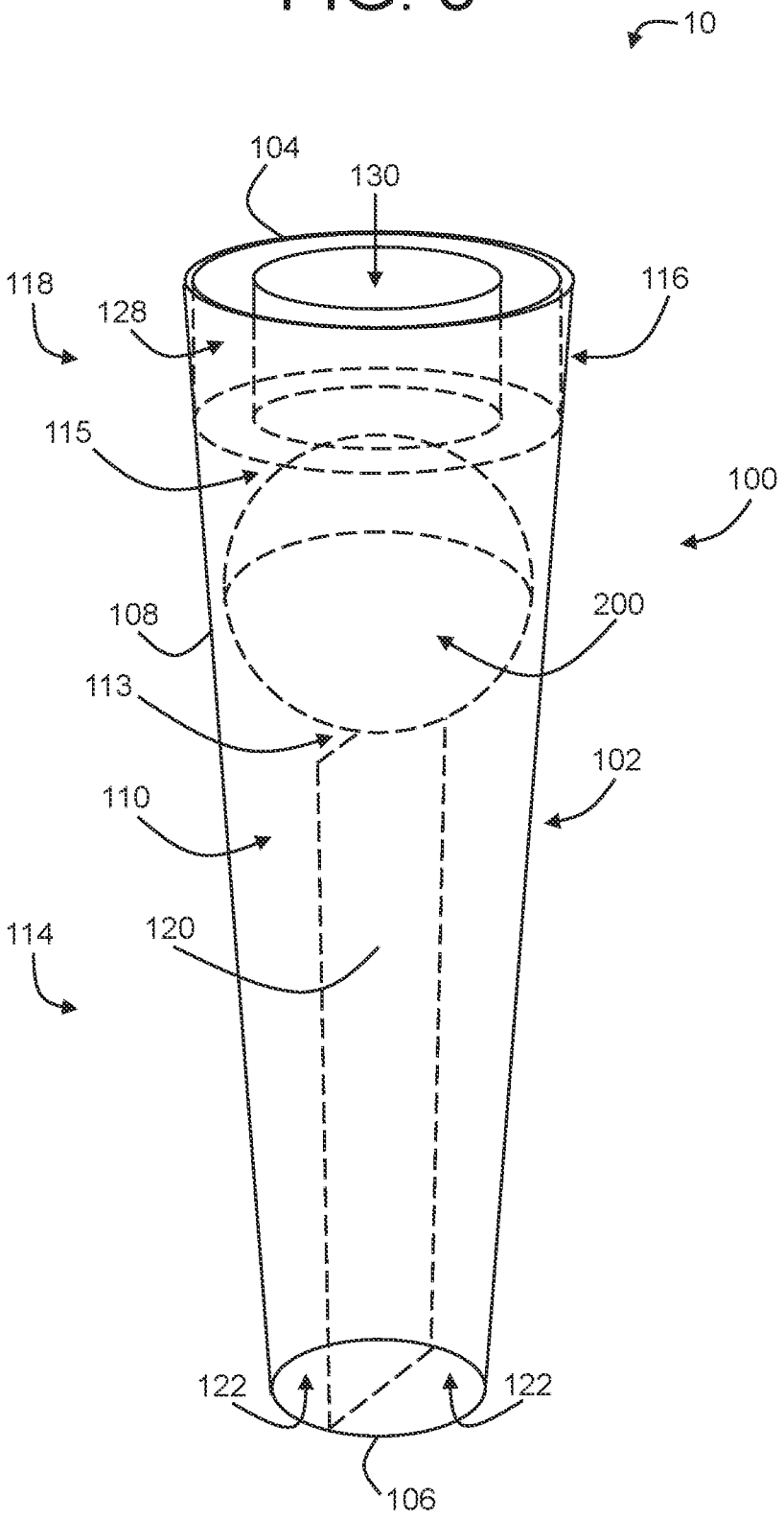
Figure 4:
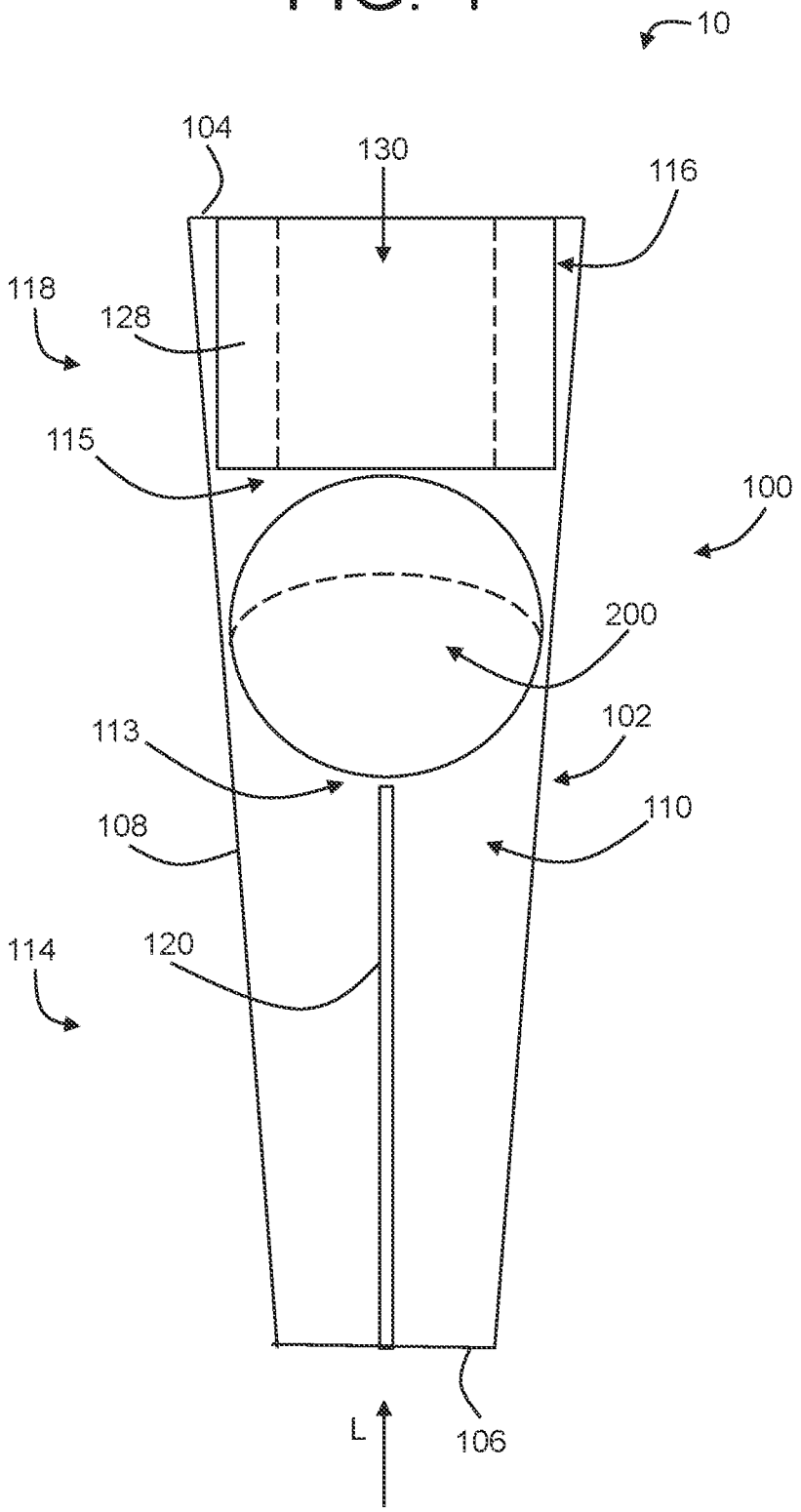
Figure 4A:
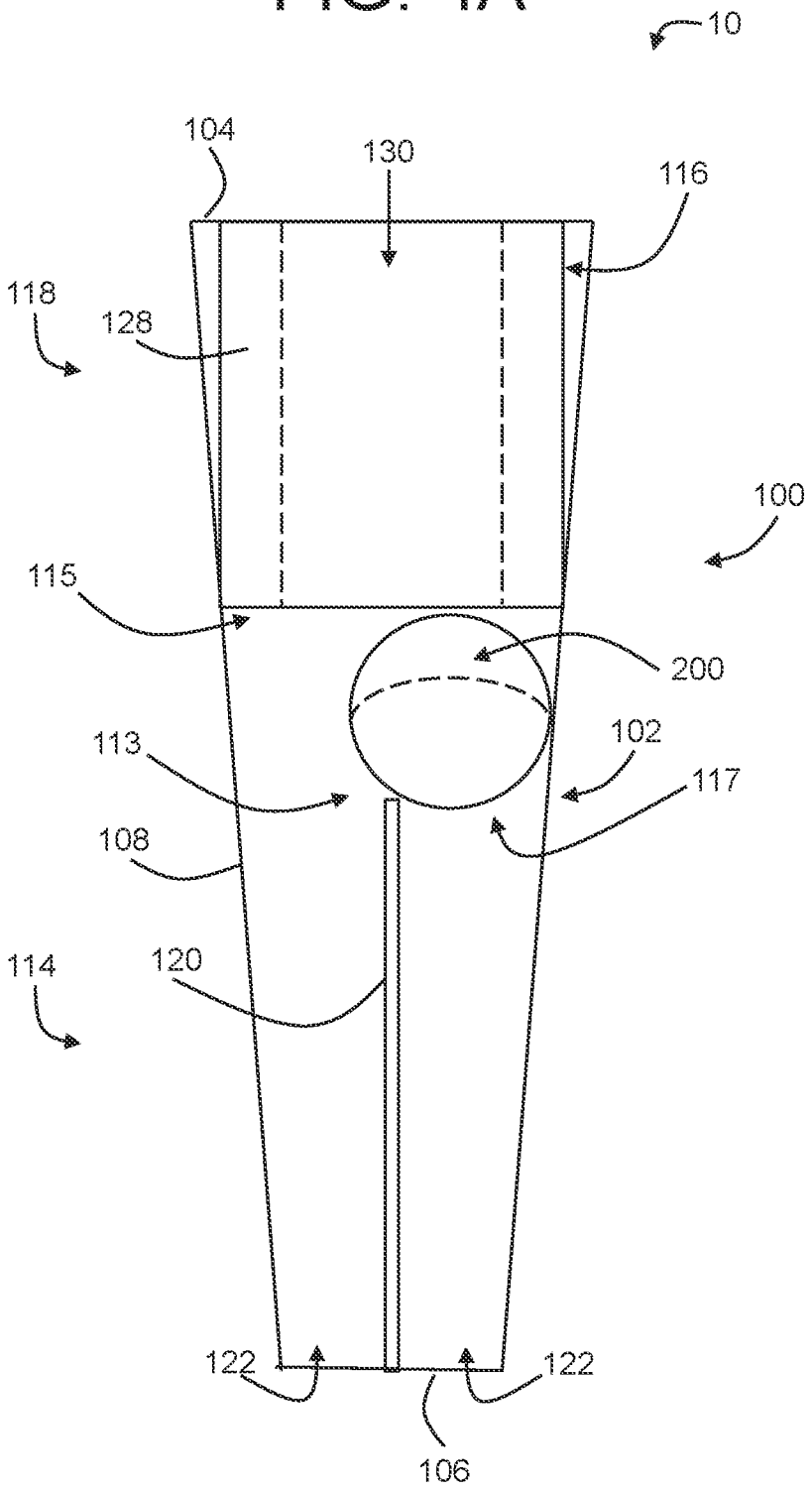

In some embodiments, as shown in FIGS. 2-4, the flavor ball 202 includes a diameter of similar size to the diameter of the inner volume 110 at the placement location of the flavor ball 202. In this case, the flavor ball 202 may rest on the top of the partition 120 as shown. In other embodiments, the flavor ball 202 may include a diameter that is smaller than the diameter of the inner volume at the placement location of the flavor ball 202. In this case, as shown in FIG. 4A, the flavor ball 202 may rest in the upper recess 117 formed at the upper end of the longitudinal compartment 122 between the top of the partition 120 and the adjacent sidewalls 108. In this way, the recess 117 may hold the flavor ball 202 from moving laterally side-to-side within the inner volume 110.

In either case, when the ball 202 is squeezed and subsequently bursts, the flavoring substance (typically a liquid) is released onto the partition 120 and onto the inner surfaces of the mouthpiece member's sidewalls 108. In this arrangement, as the user inhales, smoke/air passes through the two longitudinal compartments 122 and is in direct contact with the partition and sidewalls coated with flavoring. The smoke thereby whisks the flavoring as it passes through and delivers it to the user's mouth. Notably, the partition design provides a significant amount of surface area coated with flavoring while maximizing the through-channels (the longitudinal compartments 122) thereby allowing the smoke/air to pass through without obstruction, all while supporting the flavor ball 202 therein and/or delivering the released flavoring to the user's mouth.

As will be described in other sections, the mouthpiece member body 102 and the partition 120 may be formed together, e.g., by folding a section of material 300 (e.g., paper, cardboard, plastic, etc.). In other embodiments, the partition 120 may be separate from the mouthpiece member body 102 and may be inserted into the mouthpiece member body 102 prior to, during or after the forming of the mouthpiece member body 102.

In some embodiments, the second obstructor 116 includes any suitable type of object that may generally block the flavor releasing mechanism 200 from passing upward through the top end 104 of the member body 102. For example, in some embodiments, as shown in FIG. 2, the second obstructor 116 may include a plug 124 (e.g., ceramic, silicone, plastic, wood, carboard, etc.) with holes 126 passing from the plug's topside to its bottom side so that smoke and air may pass through the plug 124 as the user inhales through the member body 102.

In some embodiments, as shown in FIGS. 3-4, the second obstructor 116 includes a tube 128 with a central opening 130 passing from the tube's topside to its bottom side so that smoke and air may pass through the tube 128 as the user inhales through the member body 102. As shown, the tube's central opening 130 preferably includes an inner diameter that is greater than the width (e.g., the outer diameter) of the flavor releasing mechanism 200 so that the flavor mechanism 200 may not pass past the tube 128 in an upward direction.

It is understood that the examples of the second obstructor 116 described above are meant for demonstration and that the second obstructor 116 may include any type of element that suitably obstructs the flavor releasing mechanism 200 from passing from within the insert member's inner volume 110 out through the top opening 104. For example, as described in other sections, the second obstructor 116 may include a partition (similar to the partition 120).

While the second obstructor 116 of FIG. 2 (the plug 124) is shown as generally frustum shaped to generally match the frustum shape of the body member 102 in the area of the obstructor 116, it is understood that the obstructor 116 (the plug 124) may be cylindrical and/or any other suitable shape that may be positioned within the upper area of the body member 102 to hold the flavor releasing mechanism 200. In addition, while the second obstructor 116 of FIG. 3 (the tube 126) is shown as generally cylindrical, it is understood that the second obstructor 116 may be frustum shaped, and/or any other shape as desired.

In some embodiments, the second obstructor 116 may include any suitable type(s) of materials, such as, without limitation, silicone, rubber, plastic, ceramic, paper, cardboard, wood, other suitable materials, and any combination thereof.

In some embodiments, the second obstructor 116 may include filtering materials, such as, without limitation, cotton, cellulose acetate, other types of filter materials and/or tow materials, and any combinations thereof. The second obstructor 116 also may include one or more plant materials, such as, but not limited to, husk material, leaf material, stalk material, stem material, seed material, vegetable material, fruit material, other types of plant material(s), and any combinations thereof. In any event, it is understood that the second obstructor 116 is generally porous (or includes through-holes if the second obstructor 116 comprises ceramic, plastic, or other solid materials) to allow smoke to pass into the body member's inner volume 110 while optionally filtering the smoke. It is understood that filtering of the smoke also may include blocking particles of the smokable material that may not be fully combusted (e.g., parts of the smokable plant material).

In some embodiments, the second obstructor 116 (e.g., the plug 124, the tube 126, any other type of obstructor 116, etc.) may be held in place in the upper area of the inner volume 110 (e.g., at or in close proximity to the top end 104) via pressure fit, friction, adhesive, tape, by using other attachment methods, and any combinations thereof.

Figure 5:
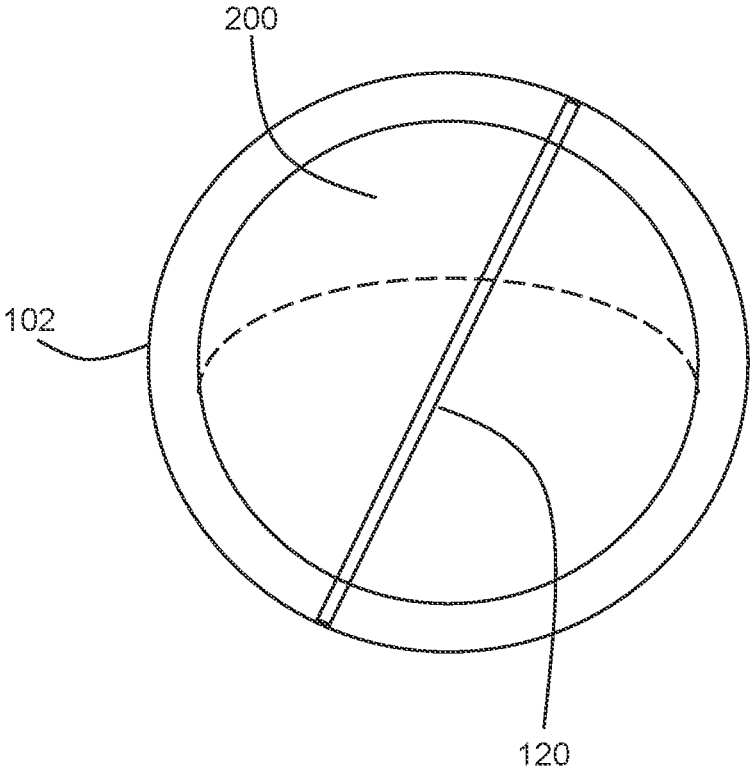

In some embodiments, FIG. 5 shows the body member 102, the partition 120, and the flavor releasing mechanism 200 of FIG. 4 taken from the perspective of the arrow L in FIG. 4.

Figure 6:
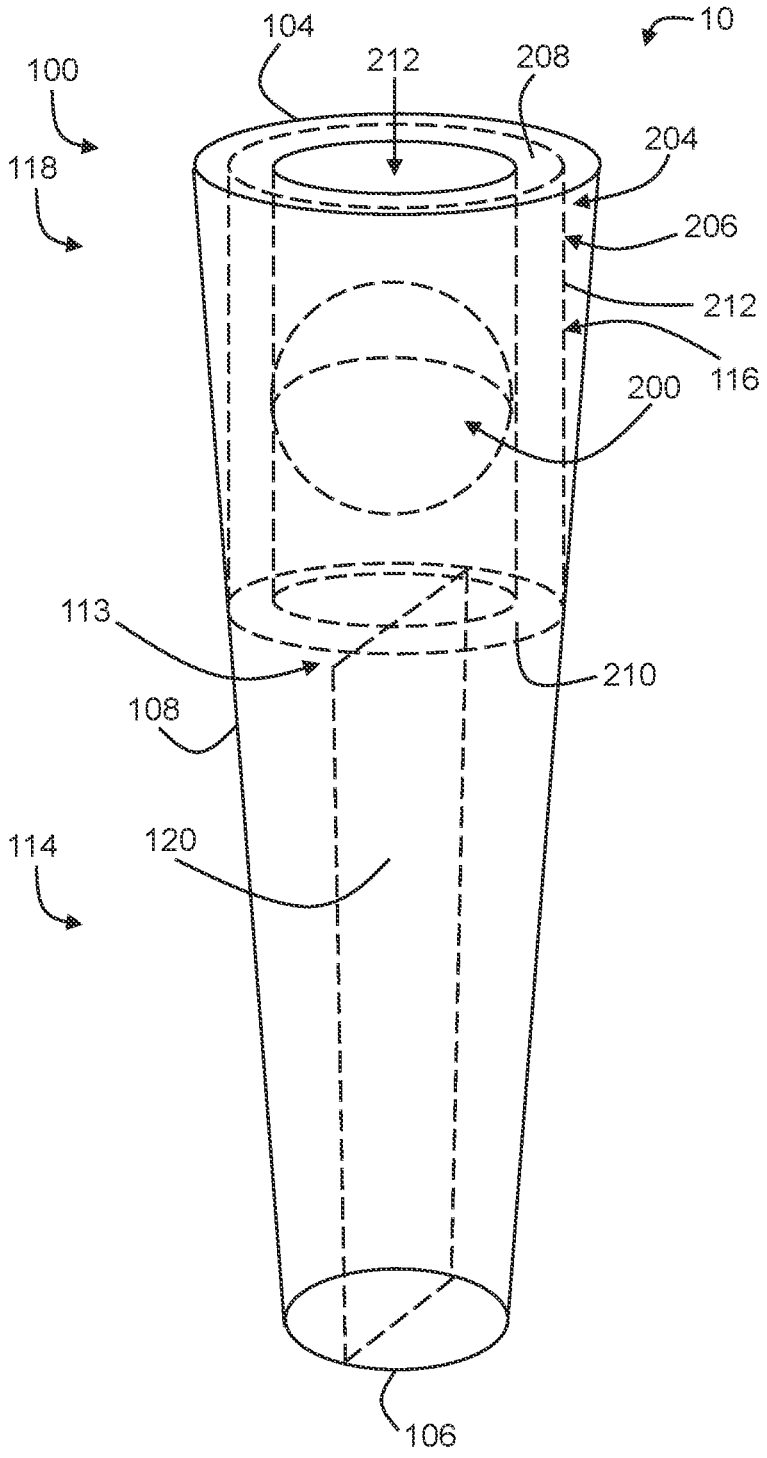

In some embodiments, as shown in FIG. 6, the flavor releasing mechanism 200 is held within a holder element 204 generally comprising a generally tubular structure 206 including a first end 208 (e.g., a top end), a second end 210 (e.g., a bottom end), and sidewalls 212 extending from the first end 208 to the second end 210. The holder element 204 may be cylindrical, frustum shaped, conical, and/or other applicable shape(s), with the holder element 204 including a hollow inner passageway 214 extending between the first end 208 and the second end 210. In some embodiments, diameter of the inner passageway 214 (or at least a portion thereof) corresponds to the outer diameter of the flavor releasing mechanism 200 so that the mechanism 200 is held snug within the holder 204 by pressure fit, friction, wedging, other securing techniques (e.g., adhesive), and any combinations thereof. Additional details of the holder element 204 will be described in other sections.

In some embodiments, as shown in FIG. 6, the bottom end 210 of the holder element 204 generally abuts (and/or is adjacent to) the top of the partition 120 (e.g., at the first intermediate location 113) and the element's top end 208 is generally flush with (and/or is adjacent to) the top 104 of the mouthpiece member body 102. The width (e.g., the outer diameter) of the holder element 204 preferably generally corresponds to the inner diameter of the mouthpiece member body 102 at the first intermediate location 113 (or thereabouts) so that the holder element 204 may be held in place therewithin by pressure fit, friction, wedging, other securing techniques (e.g., adhesive), and any combinations thereof.

Figure 7:
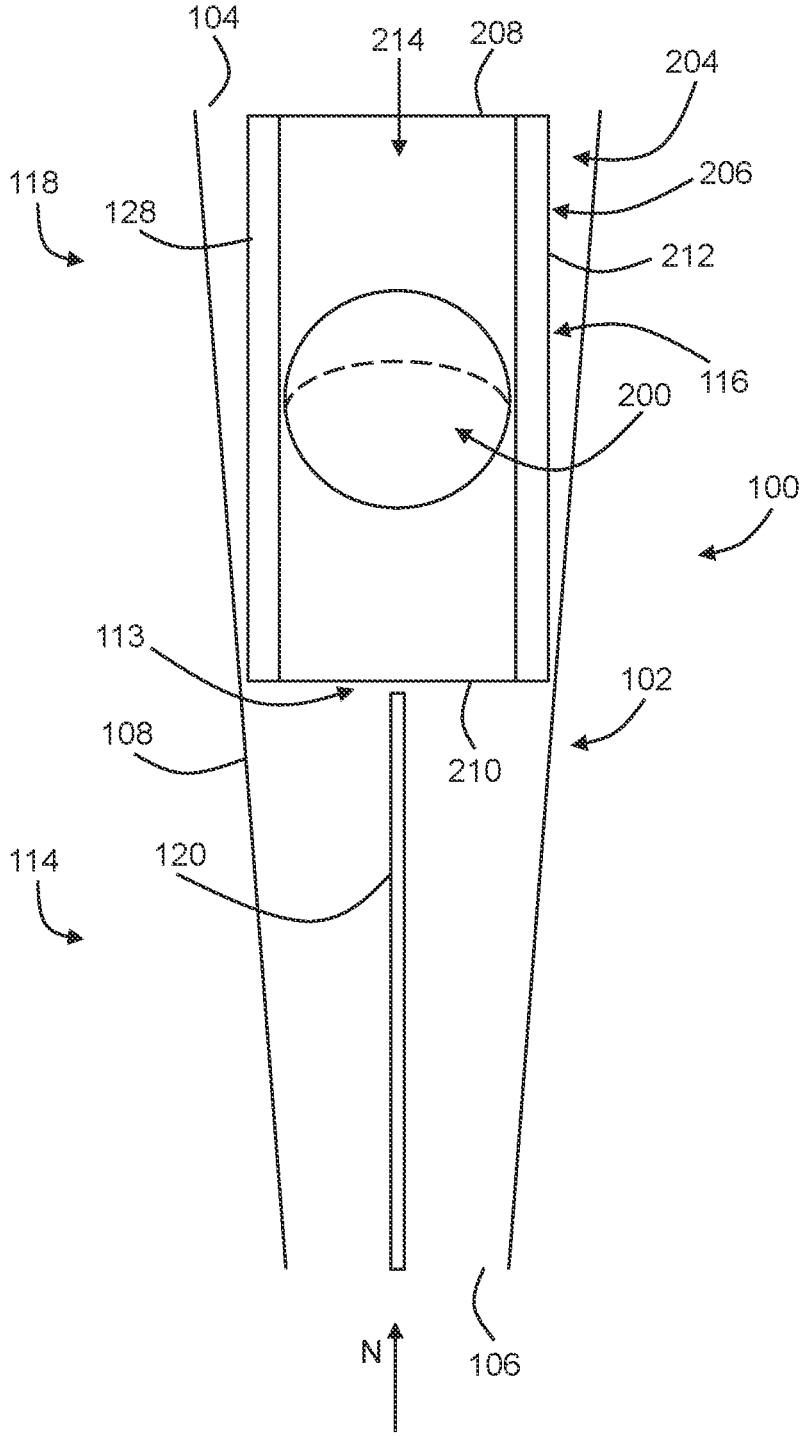
Figure 8:
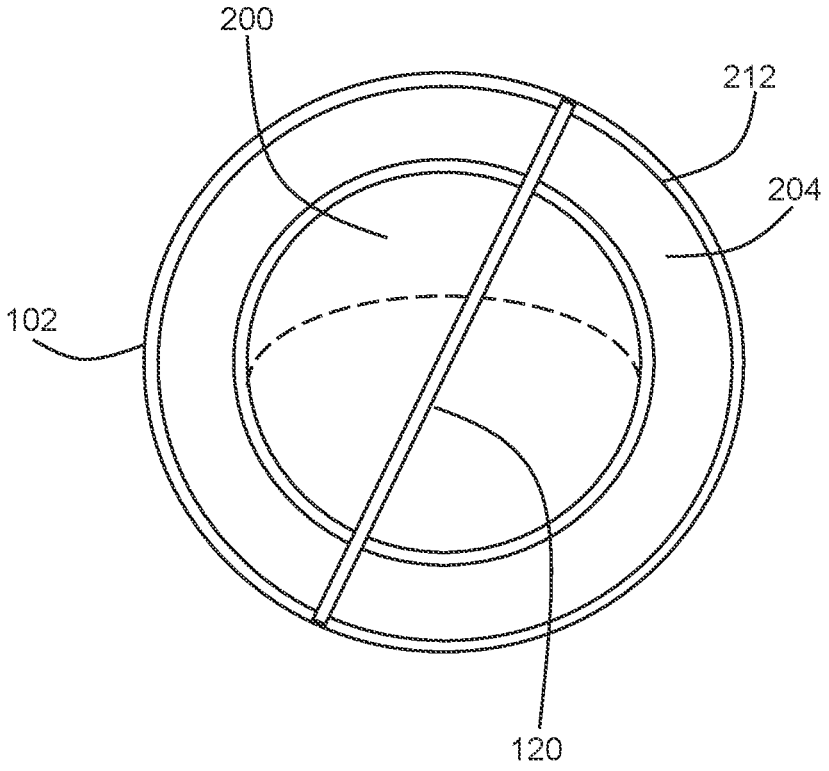

In some embodiments, FIG. 8 shows the body member 102, the partition 120, the holder element 204, and the flavor releasing mechanism 200 of FIG. 7 taken from the perspective of the arrow N in FIG. 7.

Forming the Body Member 102 and the Partition 120:

In some embodiments, the body member 102 including the partition 120 is formed from a section 300, e.g., of paper, cardboard, plastic, silicone, rubber, plant material(s) (e.g., leaves), composite material(s), any other suitable material(s), and any combinations thereof.

Figure 9:
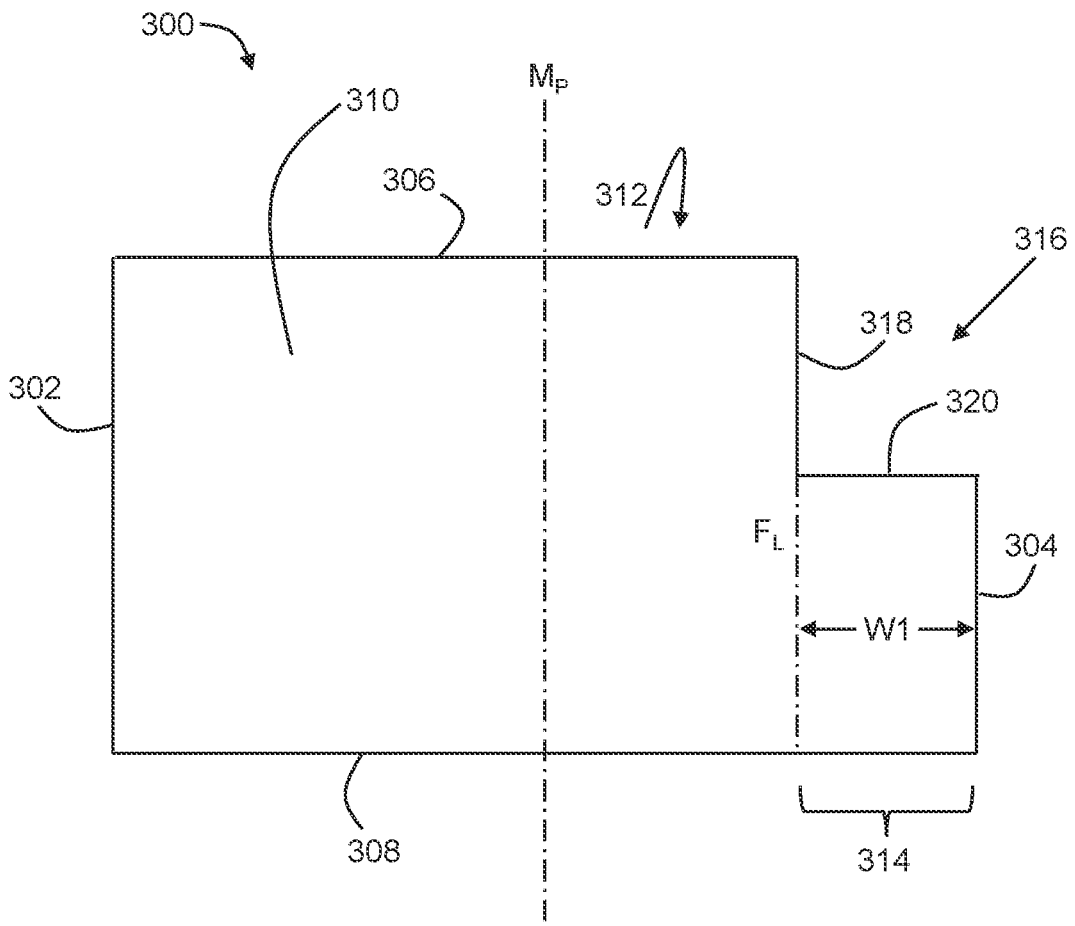
FIGS. 9-11 show aspects of a section for forming an insert system according to exemplary embodiments hereof.
Figure 10:
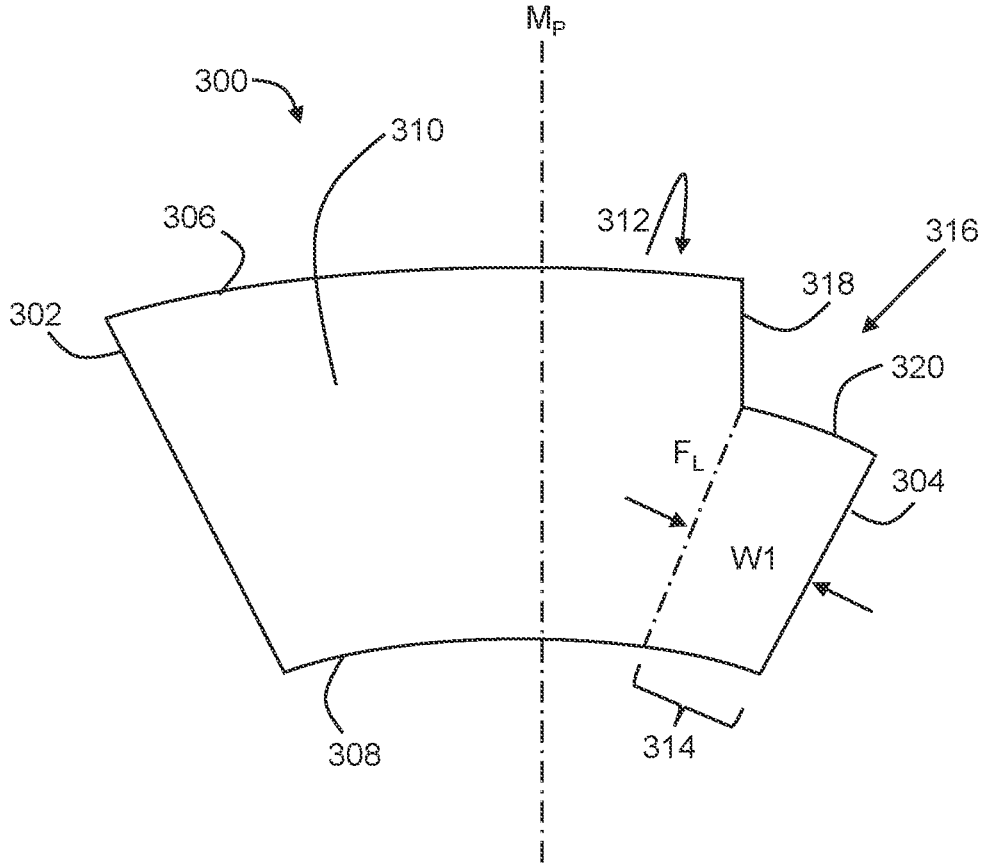

As shown in FIGS. 9 and 10, the section 300 includes a left side edge 302 (also referred to as a first side edge), a right side edge 304 (also referred to as a second side edge), a top side 306, a bottom side 308, a front 310, and a back 312. As described in other sections, the section 300 may be rolled upon itself to form an insert body 102 comprising an elongate member with sidewalls 108 defining an inner volume 110 (see FIG. 2) adapted to receive, contain, and secure one or more flavor releasing mechanisms 200.

The section 300 may comprise a flat piece of paper, cardboard, plastic, silicon, rubber, plant material(s) (e.g., leaves), composite material(s), any other suitable material(s), and any combinations thereof. The section 300 is preferably a thin type of suitable material that is preferably non-toxic, flavorless, and burnable without adding any residual flavor to the smokable. In addition, the section 300 also is preferably at least somewhat porous so that it may disperse the flavoring released by the one or more flavor releasing mechanisms 200 evenly (however, this may not be necessary).

In some embodiments as shown in FIG. 9, the section 300 is generally rectangular in shape and may be used to form a generally cylindrical or tubular insert system 10. In other embodiments as shown in FIG. 10, the section 300 is shaped as an opened frustrum wherein the shape includes a leftward slanting left side edge 302, and a rightward slanting right side edge 304, a convex top side 306, and a concave bottom side 310. In this embodiment, the section 300 is used to form a generally frustum-shaped insert system 10 (e.g., a cone). It is understood that the shapes described above are meant for demonstration and that the section 100 may be formed as any suitable shape (e.g., trapezoidal, etc.).

Figure 15:
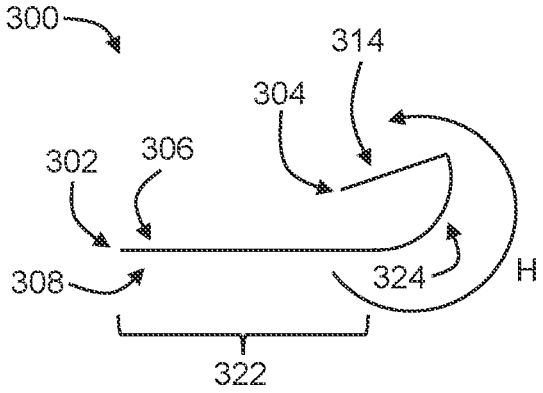

In some embodiments as shown in FIGS. 9 and 10, the section 300 includes a midpoint $M_p$ located midway between the left side edge 302 and the right side edge 304. The section 300 also includes a folding portion 314 comprising a portion with width $W_1$ generally aligned along the section's right side edge 304 (or left side edge 302). As will be described in other sections, the folding portion 314 may be folded along a fold line represented by the line $F_L$ to form the first obstructor 112, e.g., the partition 120 within the insert body 102 (see FIG. 2). As will be described in other sections, in some embodiments, the width $W_1$ of the folding portion 314 is chosen to be about equal to a desired diameter of the resulting insert system 10 (as shown in FIG. 15).

For the purposes of this specification, the forming of the body member 102 and the partition 120 using the section 300 will be described primarily with respect to the section 300 embodiment of FIG. 10 (e.g., the open frustum shaped section 300). However, it is understood that the methodology described herein also may be applied to any other embodiment(s) of the section 300 described herein or otherwise.

Notably, the section 300 shown in FIG. 9 includes a cutout 316 defined by edges 318 and 320. In general, the cutout 316 represents an area of the section 300 that does not include any material. The cutout 316 may be formed using several different techniques as described herein.

Figure 11:
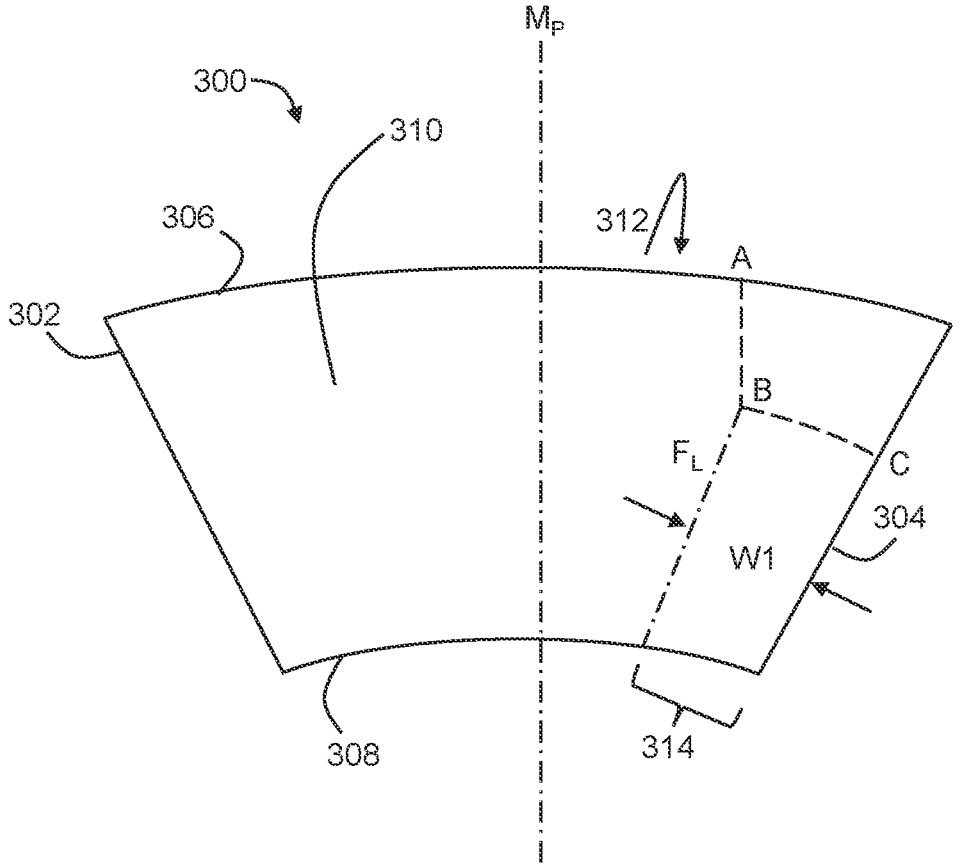

In some embodiments, the section 300 of FIG. 9 may be formed by starting with the section 300 of FIG. 10 and then forming the cutout 316. For example, in some embodiments, as shown in FIG. 11, the section 300 may be initially formed as a full open frustum (or rectangle, etc.), and the cutout 316 may then be formed by removing, displacing, or otherwise eliminating the material in the area of the cutout 316.

In a first example, in some embodiments, the material may be cut from point A to point B and from point C to point B thereby cutting out the material to form the cutout 316. In a second example, the material may be cut from point C to point B and the material may be folded along the line formed between point A and point B (A-B) to displace the material in the area of the cutout 316. In this example, the material may be folded sideways along the line A-B towards the left edge 302 while overlaying the front 310 or the back 312 of the section 300 thereby displacing the material from the area forming the cutout 316. In a third example, the material may be cut from point A to point B and the material may be folded along the line formed between point B and point C (B-C) to displace the material in the area of the cutout 316. In this example, the material may be folded downward along the line B-C towards the bottom 308 to overlay the front 310 or the back 312 of the section 300 thereby displacing the material from the area forming the cutout 316.

It is understood that the examples described above are meant for demonstration and that the examples are not limiting. For example, the section 300 of FIG. 9 may be formed directly (e.g., die cut) without starting with the section 300 of FIG. 10. In any event, it is understood that the cutout 316 may be formed using any suitable technique and that the scope of the system 10 is not limited in any way by the way in which the cutout 316 is formed.

In any of the embodiments described herein, and for the purposes of this specification, any portion of the section 300 that was displaced to form the cutout 316 (e.g., material folded along lines A-B and/or B-C that then overlays the front 310 and/or back 312 of the section 300 as described above) is considered part of the portion of the section 300 that it may overlay. For example, if the material is cut along line the A-B and then folded downward to overlay at least part of the remaining folding section 314, the overlaid material will be generally considered as part of the folding section 314 and may be folded therewith. In another example, if the material is cut along the line B-C and then folded sideways to overlay at least part of the section 300, the overlaid material will be generally considered as part of the section and may be folded therewith.

With respect to the shape of the cutout 316, while the line A-B in FIG. 11 is shown as generally vertical with respect to the layout shown and the line B-C is shown to generally follow the curvature of the bottom 308 of the section 300, it is understood that the lines A-B and/or B-C may follow any curvatures as required. For example, the line A-B may follow the general curvature of the section's right side 304 and/or the line B-C may include a horizontal line with respect to the layout shown. In any event, the cutout 316 is preferably formed as a shape that enables the portion of the section 300 below the cutout 316 to be formed as the first obstructor 112 (e.g., as a partition 120) during the forming of the insert body member 102. It is understood that the cutout 316 may be formed as any suitable shape to enable the section 300 to be adequately formed into the body member 102 and that the scope of the system 10 is not limited in any way by the shape of the cutout 316.

Once the cutout 316 has been formed using any suitable technique(s), the section 300 of FIG. 9 is provided. Next, with the section 300 generally flat, the folding portion 314 is folded upward at the fold line $F_L$ in the direction of the arrow D such that the portion 314 extends upward as shown. In some embodiments, the folding portion 314 may extend upward at an angle of about 45° with respect to the section's unfolded portion 322 (the unfolded portion 322 being generally to the left of the folding portion 314) but it is understood that the folding portion 314 may be folded at any suitable angle in order for the section 300 to perform its functionalities.

Figure 12:
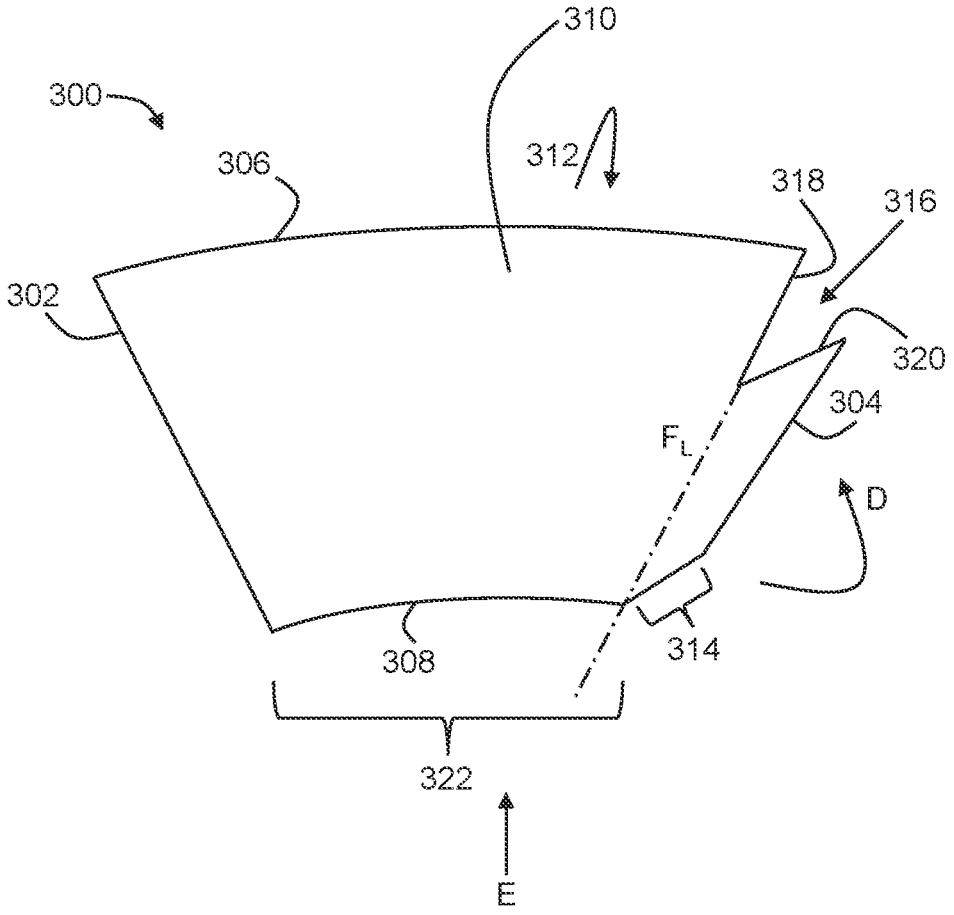
FIGS. 12-18 show aspects of a insert system during its formation according to exemplary embodiments hereof.
Figure 13:
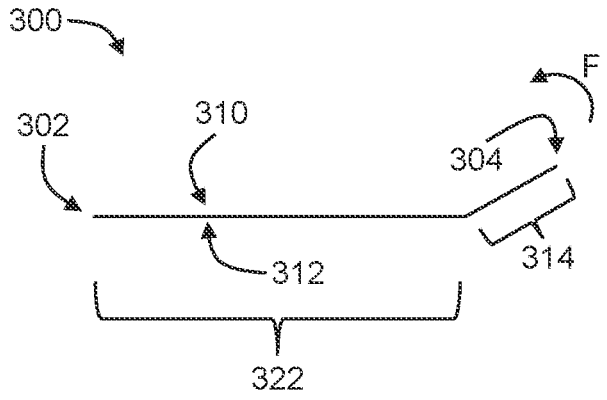

FIG. 13 shows the section 300 of FIG. 12 after the initial folding of the folding portion 314 and taken from the perspective of the arrow E in FIG. 12.

Figure 14:
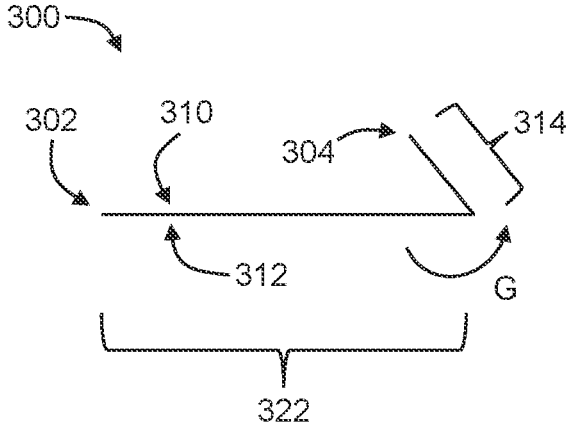

Next, as shown in FIG. 13, the folding portion 314 is folded in the direction of the arrow F resulting in the configuration shown in FIG. 14 with the folding portion 120 folded to about 135° (or to any suitable angle as required) as shown.

Next, as shown in FIG. 14, a portion of the unfolded portion 322 towards the right side of the unfolded portion 322 (e.g., a portion adjacent the folding portion 314) is curved upward in the direction of the arrow G to form an arc segment 324 (e.g., a segment of a semicircle) as shown in FIG. 15. This reduces the length of the unfolded portion 322 by the amount of the section 300 used to form the arc segment 324. Also, it is preferred that the folding section 314 remain as a generally straight section as shown and that only the arc segment 324 is formed into the curve.

Next, the arc segment 324 is increased in size by bending the portion of the unfolded portion 322 to the immediate left of the arc segment 324 upward in the direction of the arrow H as shown in FIG. 15. This results in an increased size arc segment 324 (e.g., the arc segment 324 may be formed into a semicircle) and a decreased size unfolded portion 322 as shown in FIG. 16.

Figure 16:
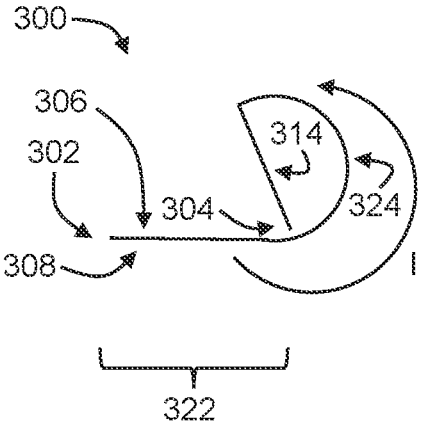
Figure 17:
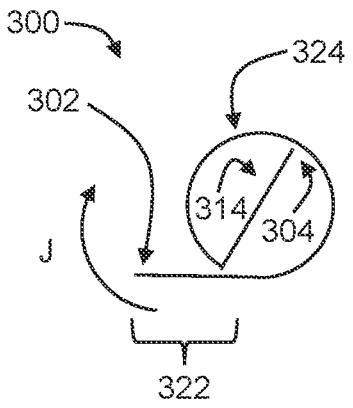

As shown in FIG. 16, at this point, the arc segment 324 may generally form a semicircle (e.g., a half circle) with the folding portion 314 extending across the half circle's base diameter. Next, a portion of the unfolded portion 322 to the immediate left of the arc segment 324 is curved upward in the direction of the arrow I in FIG. 16 to form the arc segment 324 into a full circle as shown in FIG. 17. Notably, it is preferable that the folding portion 314 generally bisect the full circle arc segment 324 as shown.

Next, the remaining unfolded portion 322 is folded around the full circle arc segment 324 in the direction of the arrow J to overlap the arc segment 324 and to effectively form the insert member body 102. Given the above, it may be preferable that the length of the unfolded portion 322 of FIG. 14 be sufficient to encircle the folding portion 314 at least once so that a full circle arc segment 324 (preferably with overlap) as shown in FIG. 18 may be formed.

Figure 18:
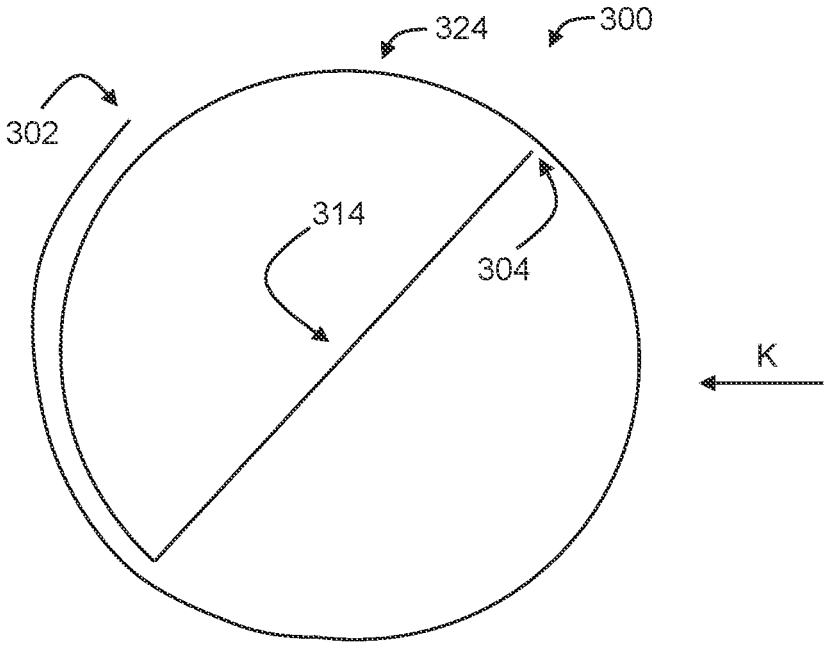
Figure 19:
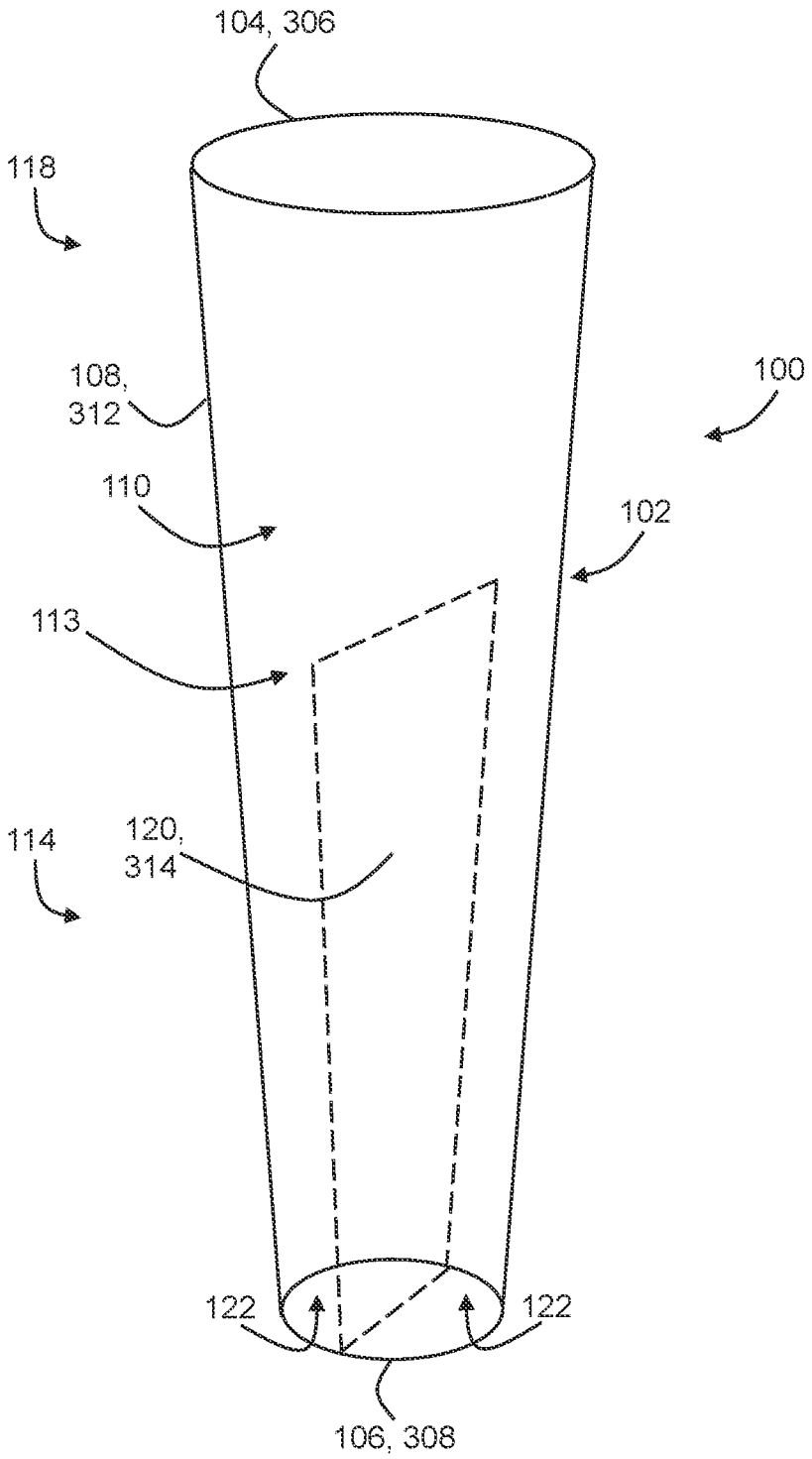
FIG. 19 shows aspects of an insert system according to exemplary embodiments hereof.

FIG. 19 shows the insert body 102 formed from the section 300 taken from the perspective of the arrow Kin FIG. 18. The top 104 of the insert body member 102 generally comprises the curved and/or folded top 306 of the section 300, and the bottom 106 of the insert body member 102 generally comprises the curved and/or folded bottom 308 of the section 300.

In some embodiments, as shown in FIG. 19, the folding portion 314 forms the partition 120 within the inner volume 110 generally extending from the bottom 106 to the intermediate location 113. The partition 120 generally extends across the inner volume 110 from generally opposing locations along the inner surface of the sidewalls 108. In some embodiments, it may be preferable that the partition 120 bisect the cross-section of the inner volume 110, but this may not be required.

In some embodiments, as shown in FIG. 19, the partition 120 forms two adjacent longitudinal compartments 122 within the lower portion 114 of the inner volume 110, with each compartment preferably extending from the insert body's bottom 106 to the intermediate location 113.

Figure 20:
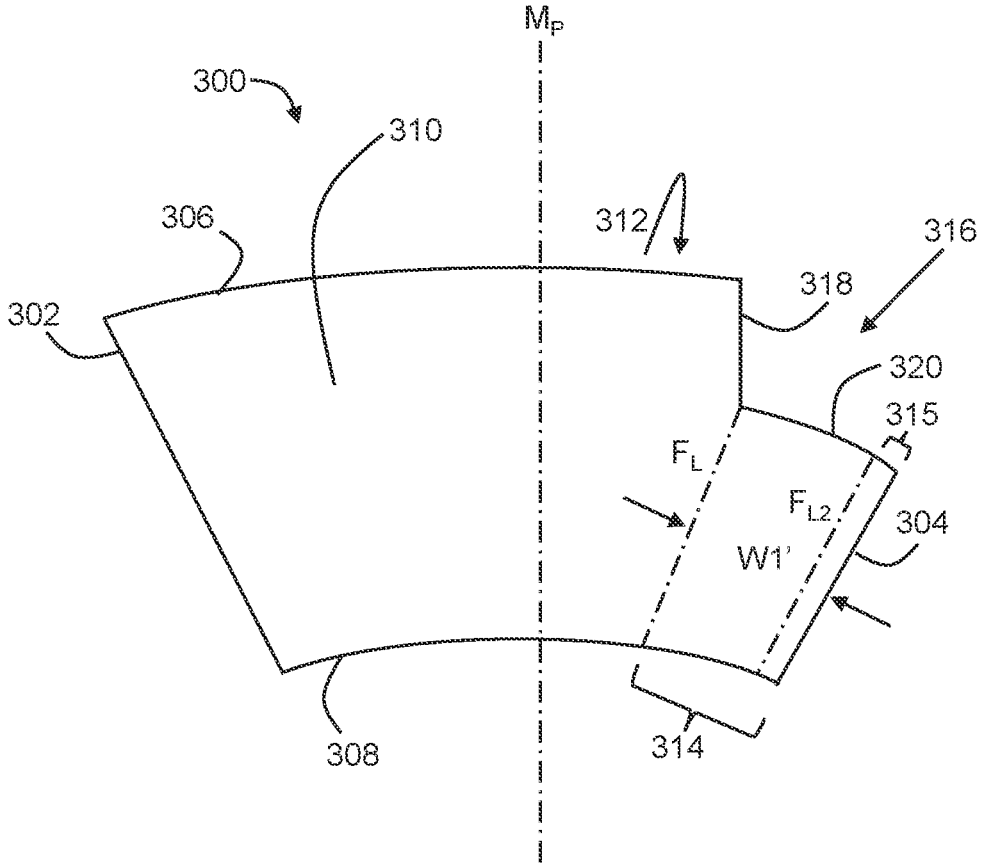
FIGS. 20-22 show aspects of a section for forming an insert system according to exemplary embodiments hereof.

In some embodiments, as shown in FIG. 20, an additional fold is performed along the fold line $FL_2$ to form a partition support section 315. This fold may be performed prior to (or at the same time or after) the fold performed along the line $F_L$ shown in FIG. 12. In some embodiments, to accommodate this additional fold, the width W1 of the folding section 314 may be increased to W1', however, this may not be necessary.

Figure 21:
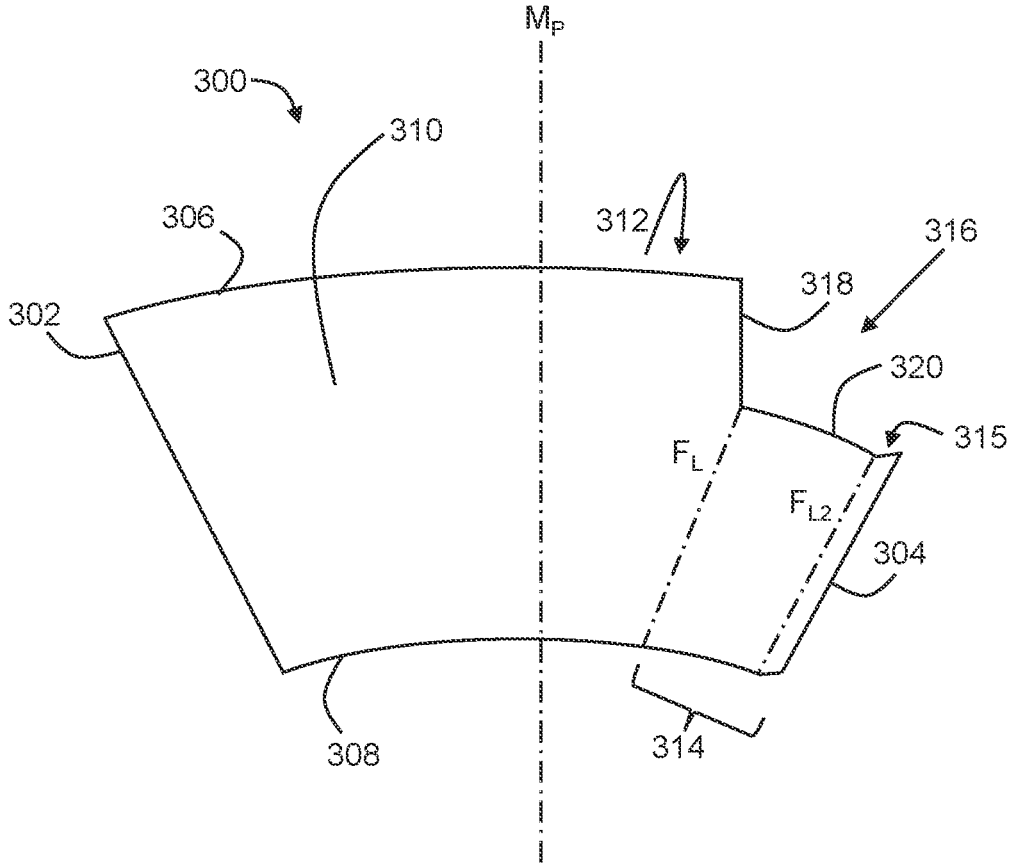

In some embodiments, this additional fold at line $F_2$ may be an upward fold and may result in the upward extending support section 315 shown in FIG. 21.

Figure 22:
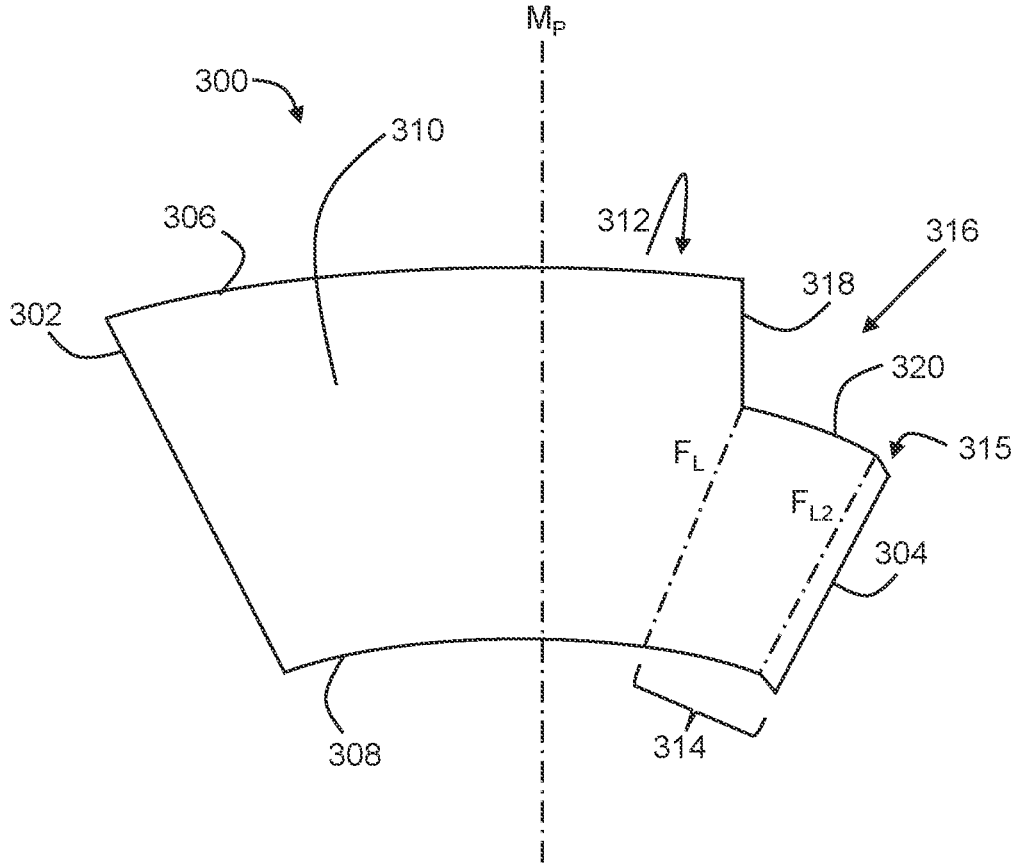

In some embodiments, this additional fold at line $F_2$ may be a downward fold and may result in the downward extending support section 315 shown in FIG. 22.

Once this additional fold is performed, the support section 315 (whether it be upward or downward) is carried throughout the remainder of the folds performed as described herein (FIGS. 12-18). This results in the configurations shown in FIGS. 23 and 24, with the support section 315 resulting from an upward fold or a downward fold, respectively. However, the intermediary actions are not shown in order to avoid duplicity. In any event, FIGS. 23 and 24 show a first fold F1 at the fold line $F_L$ of FIGS. 21 and 22, and a second fold F2 at the fold line $F_{L2}$ of FIGS. 21 and 22.

Figure 23:
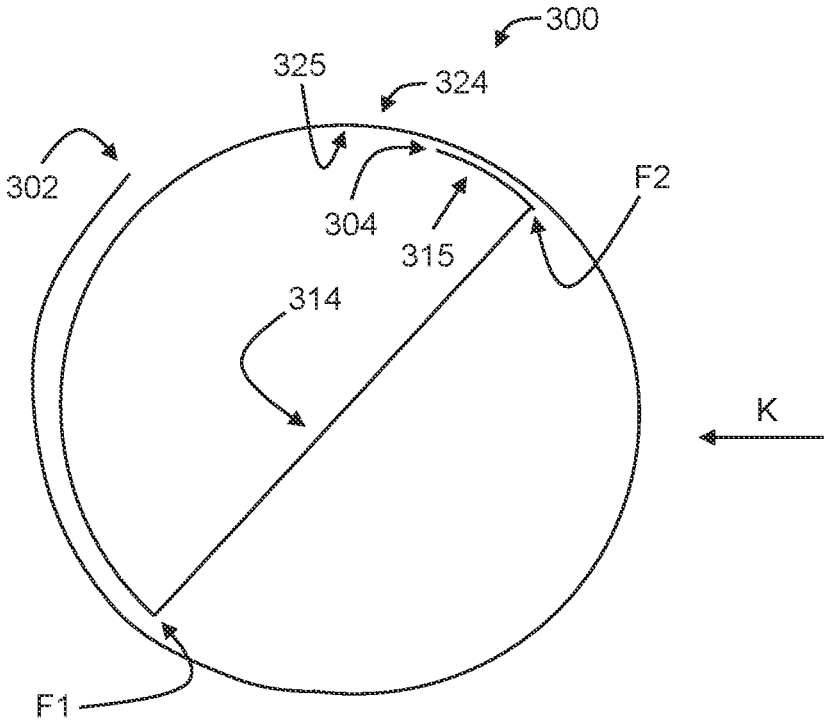
FIGS. 23-24 show aspects of an insert system according to exemplary embodiments hereof.
Figure 24:
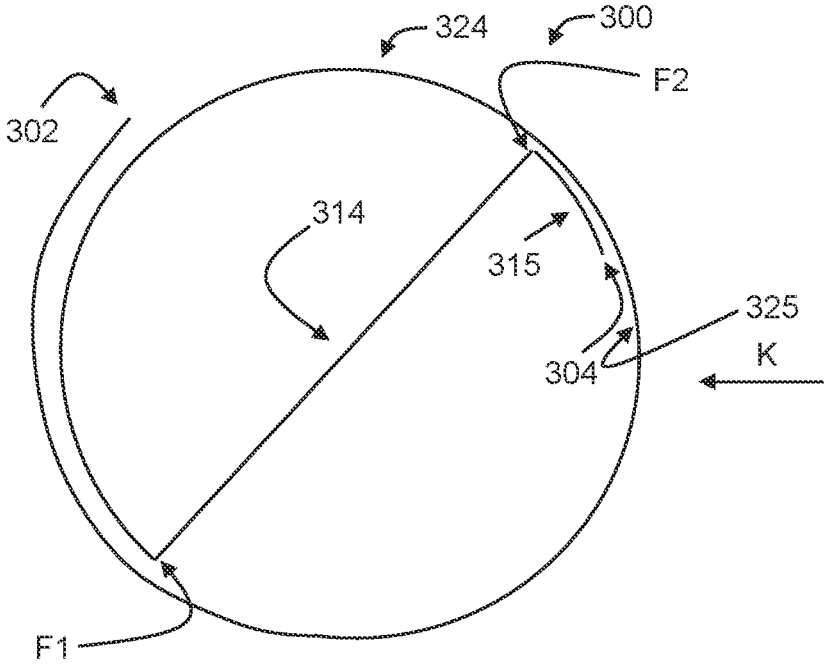

In some embodiments, as shown in FIG. 23, an upward folded support section 315 generally overlays an inner surface 325 (that corresponds to the sidewall inner surface 109 of FIG. 2) of the arc segment 324 to the left of the folding section 314 portion that extends across the cross-section of the arc segment 324 in the layout shown, and as shown in FIG. 24, a downward folded support section 315 generally overlays the inner surface 325 of the arc segment 324 to the right of the folding section 314 portion that extends across the cross-section of the arc segment 324 in the layout shown. In either case, by overlaying the arc segment 324, the support section 315 provides support to the portion of the folding section 314 that extends across the cross-section of the overall arc segment 324, thereby helping to hold it in place.

In some embodiments, once the insert member body 102 with the internal partition 120 is formed, the flavor releasing mechanism 200 may be secured within the upper portion 118 of the member's inner volume 110 as described herein to form the insert system 10.

Figure 25:
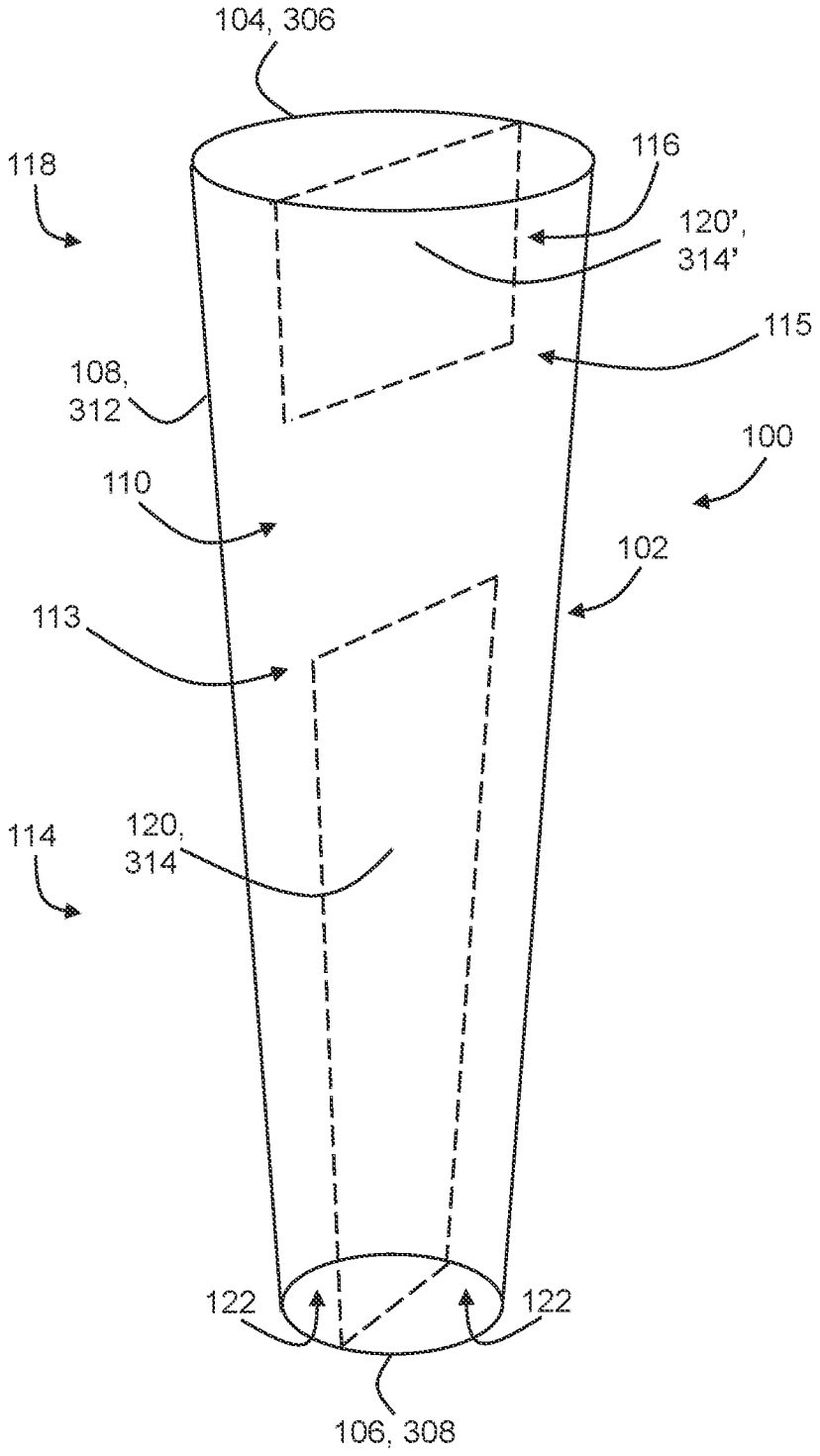
FIG. 25 shows aspects of an insert system according to exemplary embodiments hereof.
Figure 26:
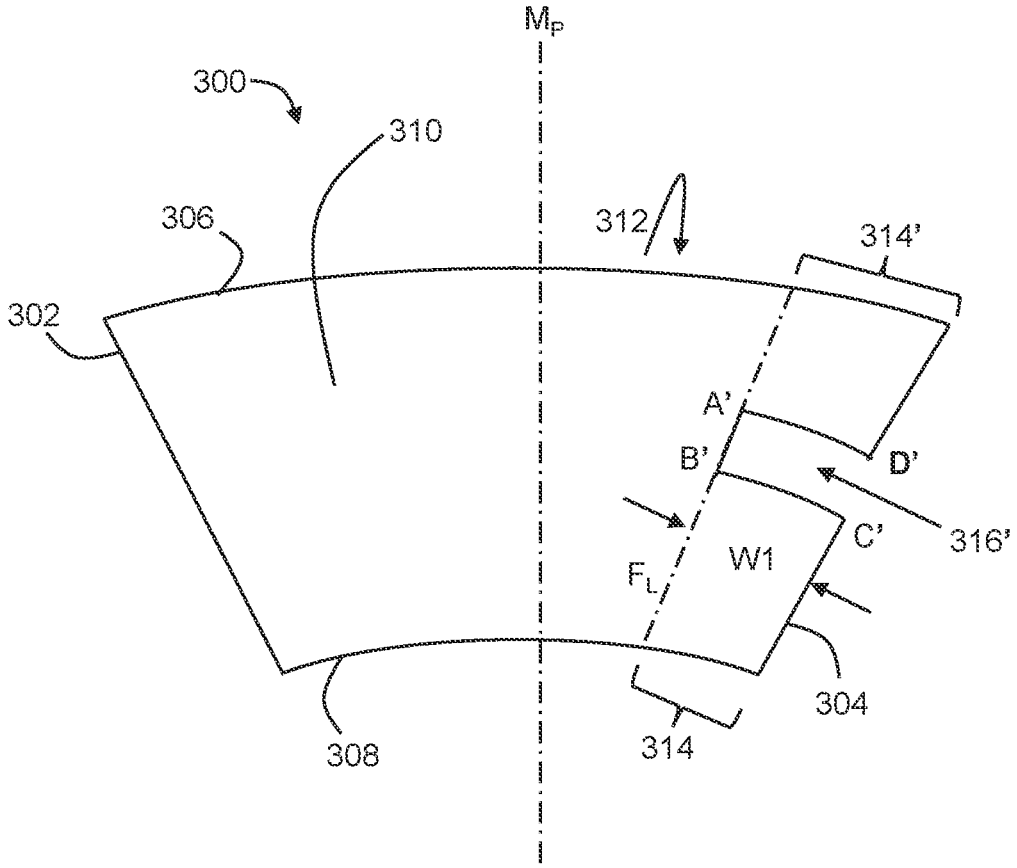
FIG. 26 shows aspects of a section for forming an insert system according to exemplary embodiments hereof.

In some embodiments, as shown in FIG. 25, the second obstructor 116 may be formed in the same or similar manner as the first obstructor 112, that is, as a partition 120' similar to partition 120 formed by the folding section 314 as described above. In this case, in some embodiments, as shown in FIG. 26, a cutout 316' is formed by removing or otherwise displacing the area defined by A', B', C', and D' thereby leaving a second folding section 314' above the cutout 316'. This second folding section 314' may be used to form an upper partition 120' in a similar manner that the first folding section 314 was used to form the lower partition 120 described above. Notably, the first folding section 314 may preferably still exist below the cutout 316' to form the lower partition 120 in parallel with forming the upper partition 120', however, this may not be required. The flavor releasing mechanism 200 may then be received and held in the cavity formed by the cutout 316' between the lower and upper partitions 120, 120' when the obstructors Accordingly, in some embodiments, the second folding section 314' is folded and wrapped to form the upper partition 120' in the same manner as the first folding section 314 was folded and wrapped to form the lower partition 120 as described in relation to FIGS. 12-22. Given this, in an effort to avoid duplicity in this written description, these actions will not be described again here. It is understood, however, that every aspect described herein in relation to forming an insert member body 102 with a first partition 120 formed using the first folding section 314 also may apply to forming the member body 102 with a second partition 120' formed using the second folding section 314'.

Figure 27:
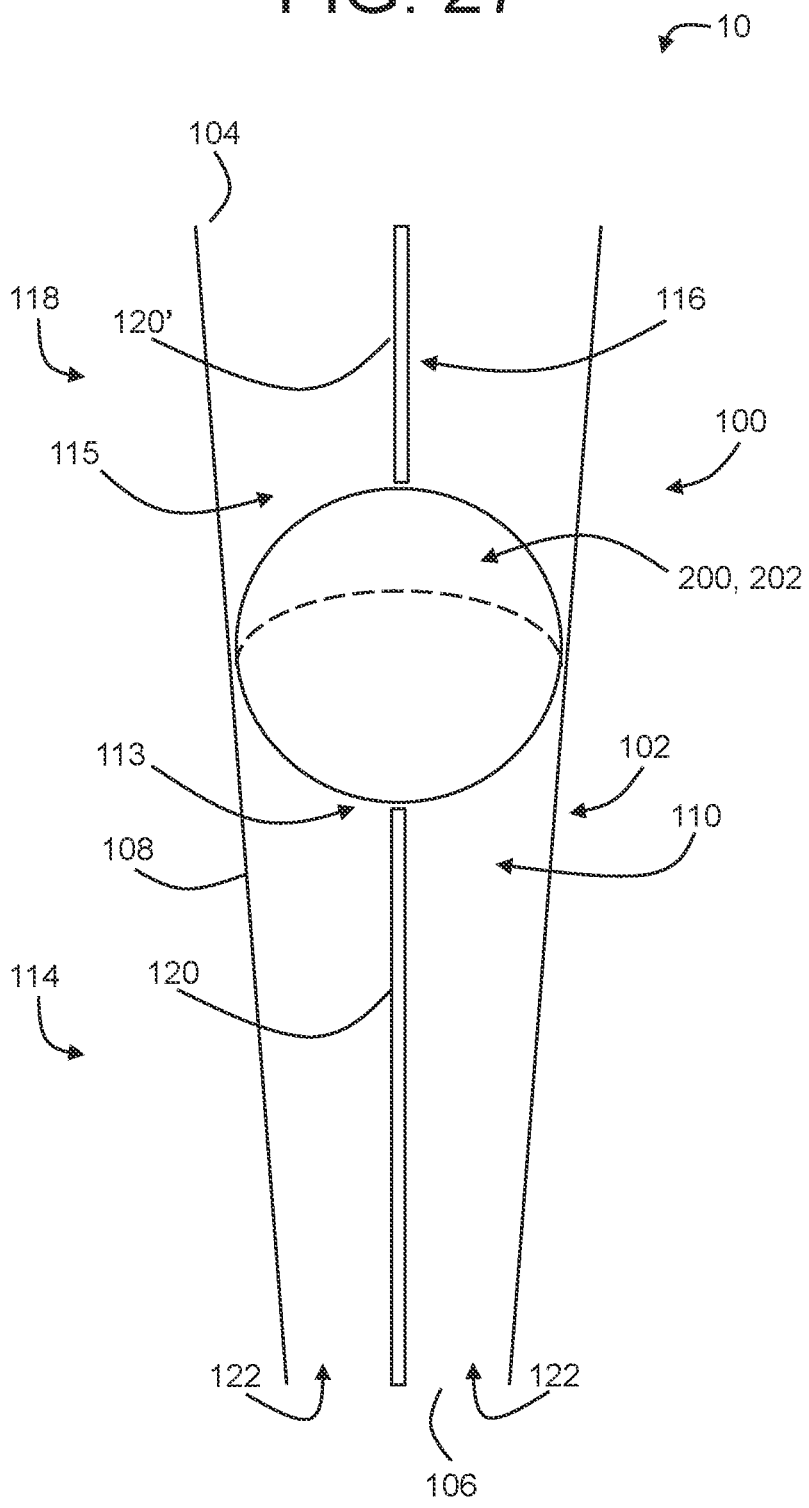
FIGS. 27-28 show aspects of an insert system according to exemplary embodiments hereof.
Figure 28:
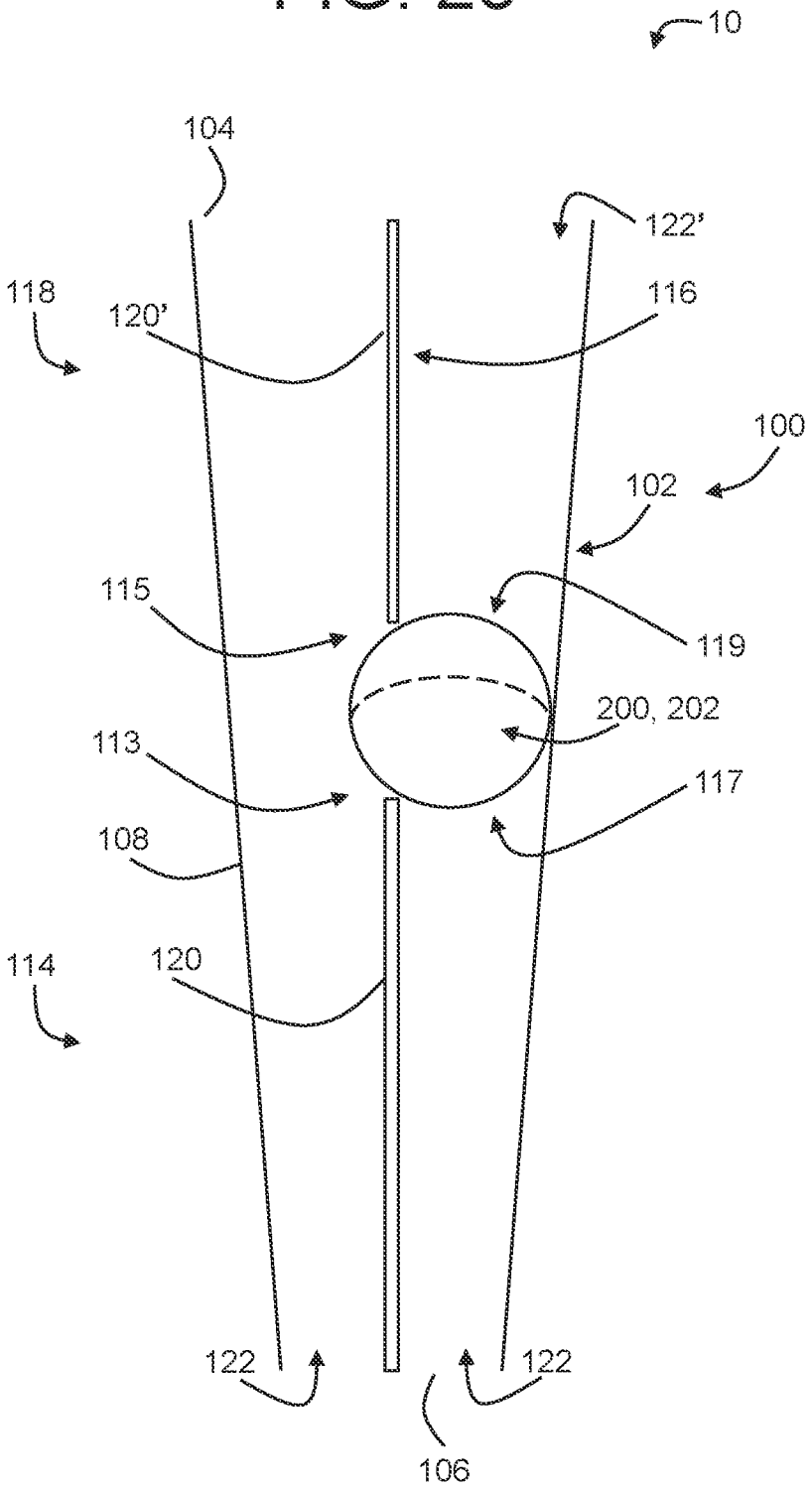

In some embodiments, as shown in FIG. 27, the flavor ball 202 includes a diameter of similar size to the diameter of the inner volume 110 at the placement location of the flavor ball 202. In this case, the flavor ball 202 may rest on the top of the lower partition 120 and beneath the upper partition 120' as shown. In other embodiments, as shown in FIG. 28, the flavor ball 202 may include a diameter that is smaller than the diameter of the inner volume at the placement location of the flavor ball 202. In this case, the flavor ball 202 may rest in the upper recess 117 formed at the upper end of the longitudinal compartment 122 between the top of the partition 120 and the adjacent sidewalls 108. In addition, an upper portion of the flavor ball 202 also may be held in the lower recess 119 formed between the lower end of the upper longitudinal partition 120' and the adjacent sidewalls 108. In this way, the recess(es) 117, 119 may hold the flavor ball 202 from moving laterally side-to-side within the inner volume 110.

In either case, when the ball 202 is squeezed and subsequently bursts, the flavoring substance (typically a liquid) is released onto the lower and upper partitions 120, 120' and onto the inner surfaces of the mouthpiece member's sidewalls 108. In this way, as the user inhales, the flavoring may be delivered to the user's mouth.

Figure 29:
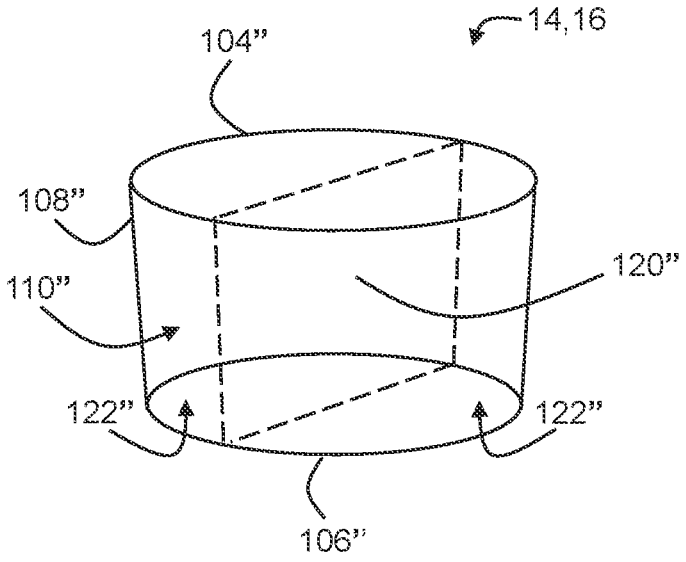
FIG. 29 shows aspects of an obstructor according to exemplary embodiments hereof.
Figure 30:
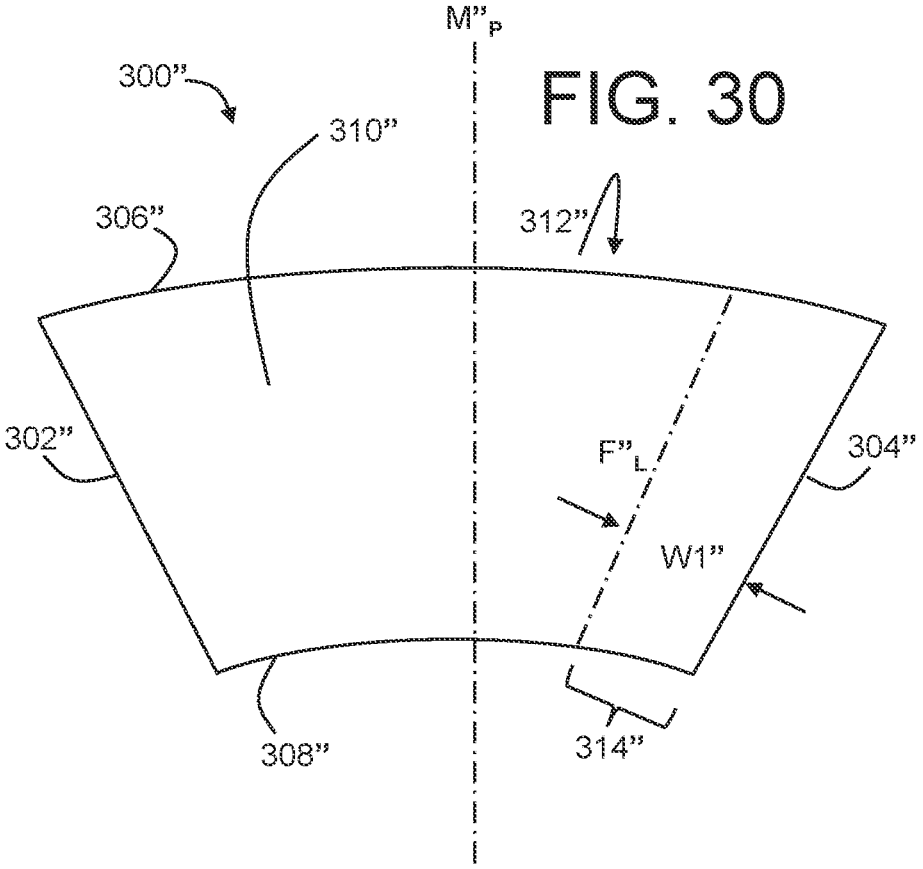
FIG. 30 shows aspects of a section for forming an obstructor according to exemplary embodiments hereof.

In some embodiments, as shown in FIGS. 29-30, the first and/or second obstructors 112, 116 may be formed separately from the mouthpiece body member 102 and then inserted into the mouthpiece body member 102. In some embodiments, the first and/or second obstructors 112, 116 are each formed as separate (stand-alone) obstructors 112", 116" using separate sections 300", each section 300" with a folding section 314". The separate obstructors 112", 116" are formed using the same (or similar) folding technique as the technique described above with respect to the mouthpiece member body 102 and the first and/or second partitions 120, 120'. Notably, however, the separate sections 300" preferably do not include cutouts. This results in conical and/or cylindrical separate obstructors 112", 116" each with a partition 120", as shown in FIG. 29.

As shown in FIG. 30, each separate section 300" includes a left side 302", a right side 304", a top side 306", a bottom side 308", a front 310", and a back 312". In addition, each separate section 300" includes a separate folding section 314" but may preferably not include a cutout, i.e., the separate sections 300" may not include a cutout similar to the cutout 316 in the primary section 300 described above.

Because the same or similar folding technique may be used as the technique used to form the mouthpiece member body 102 with an internal partition 120 above (FIGS. 12-22), these actions will not be described again here to avoid duplicity. It is understood, however, that every aspect described herein in relation to forming an insert member body 102 with a first partition 120 formed using a section 300 with a first folding section 314 also may apply to forming the first and/or second separate obstructors 112", 116" each with a partition 120".

Once formed, the first and/or second separate obstructors 112", 116" are then inserted into the first and/or second ends 104, 106, respectively, of the mouthpiece member body 102 (into the inner volume 110) to form a cavity therebetween designed to receive and secure a flavor releasing mechanism 200.

In some embodiments, as shown in FIG. 31, the first obstructor 112 may be frustum shaped (i.e., conical) and may be dimensioned to match the lower portion 114 of the mouthpiece body member 102 (which also is preferably frustum shaped) such that when inserted into the mouthpiece member 102 it may be held by the corresponding (wedge-shaped) forms and dimensions of the first obstructor 112 and the lower portion 114 of the member 102 (i.e., a frustum wedged within a corresponding frustum). Similarly, the second obstructor 116 may be frustum shaped and dimensioned to match the upper portion 118 of the mouthpiece body member 102 (which also is preferably frustum shaped) such that when inserted into the mouthpiece member 102 it may be held by the corresponding forms and dimensions of the second obstructor 116 and the upper portion 118 of the member 102 (i.e., a frustum wedged within a corresponding frustum).

In some embodiments, the above arrangement forms a space within the inner volume 110 between the first and second obstructors 112, 116 wherein the flavor releasing mechanism 200 may be positioned and held therein by the obstructors 112, 116.

Figure 32:
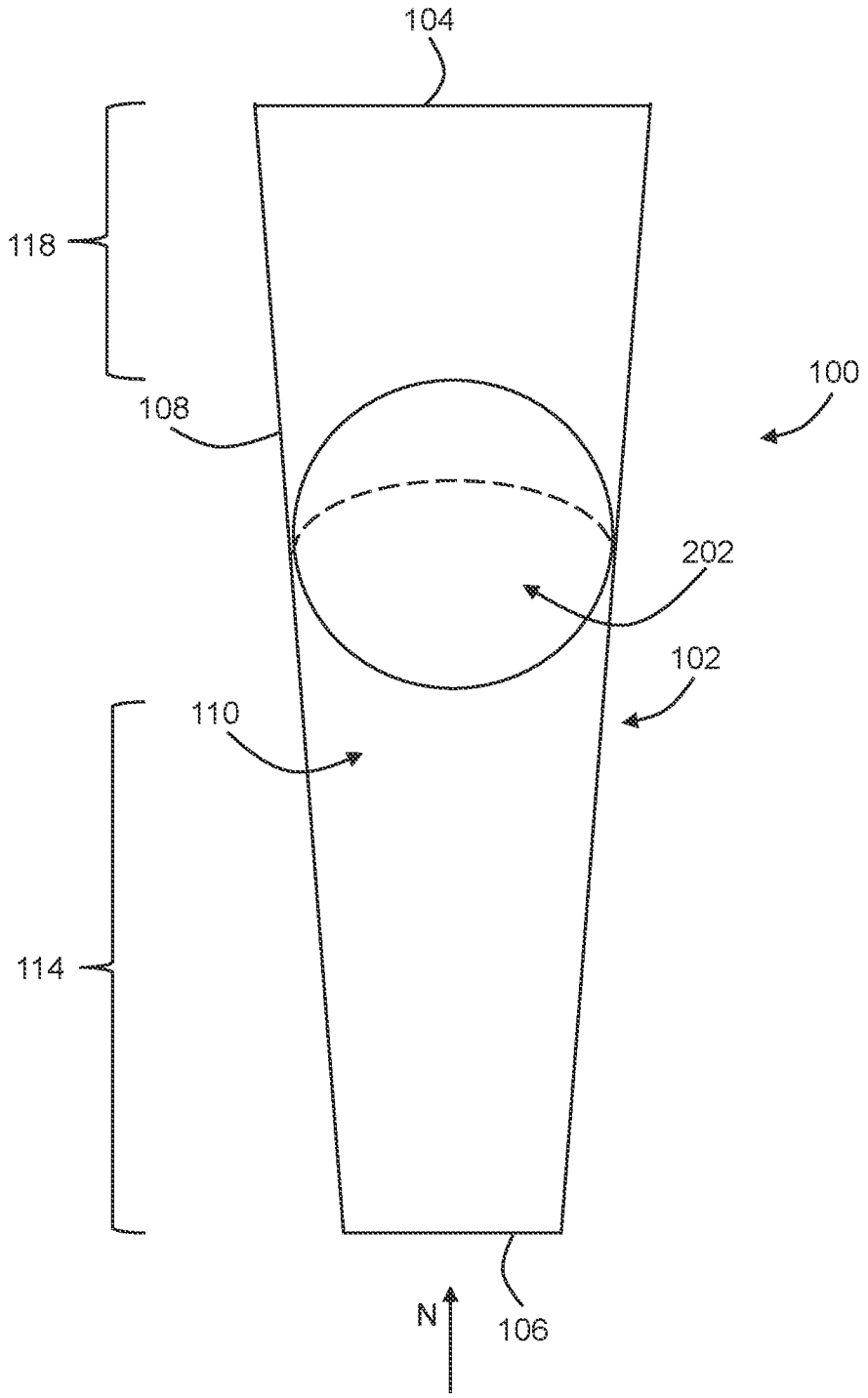
FIGS. 32-33 show aspects of an insert system according to exemplary embodiments hereof.

In some embodiments, as shown in FIG. 32, the mouthpiece body member 102 is frustum shaped thereby forming a wedge-shaped inner volume 110 defined by inwardly angled sidewalls 108. In some embodiments, the flavor releasing mechanism 200 (e.g., a flavor ball 202) includes a diameter that generally matches the diameter of the mouthpiece member 102 at a location between the member's first end 104 and its second end 106 (e.g., about midway between the first and second ends 104, 106). Accordingly, the diameter of the inner volume 110 is greater than the diameter of the flavor releasing mechanism 200 in the area above the flavor releasing mechanism 200 and smaller than the diameter of the flavor releasing mechanism 200 in the area below the mechanism 200. Given this, the flavor releasing mechanism 200 may be wedged into the inner volume 110 at the intermediate location and held in place by its abutment with the downward converging sidewalls 108.

Figure 33:
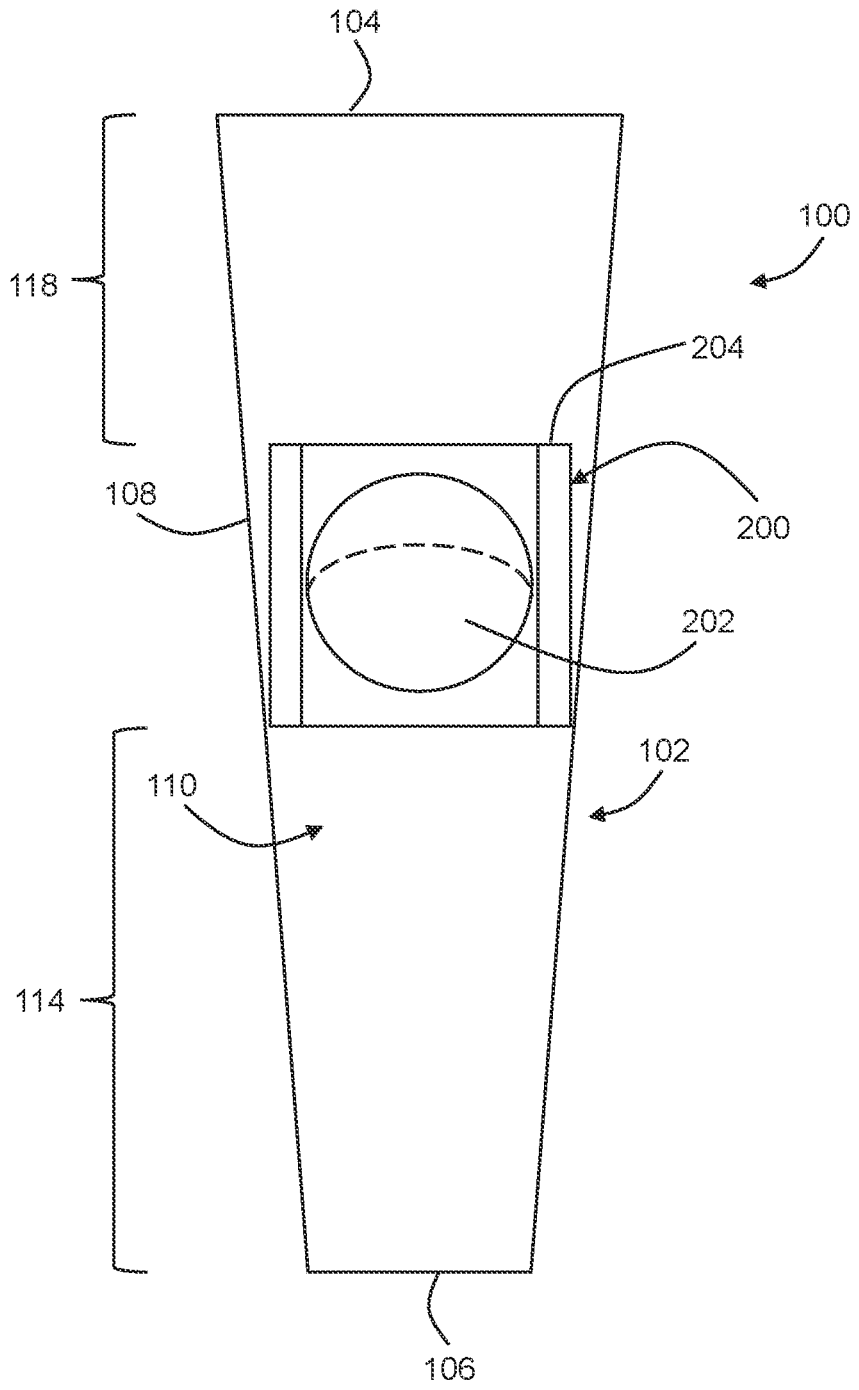

In some embodiments, as shown in FIG. 32, the flavor releasing mechanism 200 may include a flavor ball 202 by itself. In other embodiments, as shown in FIG. 33, the flavor releasing mechanism 200 may include a flavor ball 202 held within a holder element 204 with the combination being wedged at the intermediate location and held by the downward converging sidewalls 108 as described above. While the holder element 204 shown in FIG. 33 is generally cylindrical, it is understood that the holder element 204 may include any applicable shape(s), including, and not limited to, conical, frustum shaped, other shapes, and any combinations thereof.

In any of the embodiments described in relation to FIGS. 32-33, first and/or second obstructors 112, 116 may or may not be used.

Additional details regarding the flavor releasing mechanism 200 and the mechanism's holder element 204 will be described next.

Flavor Releasing Mechanisms 200

In some embodiments, the flavor releasing mechanisms 200 may include any type of solid, liquid, or gas (and any combinations thereof) that may release one or more flavors when activated. The mechanisms 200 may be designed to be activated by heat (e.g., during smoking), by pressure (e.g., may be squeezed, pricked, or otherwise exploded, etc.), by other activation techniques, and by any combinations thereof.

Figure 34:
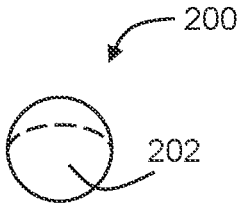
FIG. 34 shows aspects of a flavor releasing mechanism according to exemplary embodiments hereof.

In some embodiments as shown in FIG. 34, the flavor releasing mechanisms 200 include one or more flavor balls 202 (also referred to as click or pop balls) comprising a crushable spherical container with a flavoring substance inside. The flavor balls 202 may be adapted to generally burst (or otherwise open) when squeezed thereby releasing the flavoring substance. In this way, a user may squeeze a flavor ball 202 embedded within the insert system 10 (e.g., by squeezing the overall insert system 10) when a flavoring is desired during the smoking experience. While the flavor balls 202 described herein are described primarily as spherical shaped, it is understood that the flavor balls 202 may be formed as an ovoid, a cuboid, a cylinder, pill-shaped, as any other suitable shape, and as any combinations thereof.

In some embodiments, the flavor ball 202 may be placed inside a sheath (e.g., a cotton sheath) that may absorb at least a portion of the released flavoring substance and hold the substance in place as the smoke passes through the insert system 10.

It is understood that any other type(s) and/or shapes of flavor releasing mechanisms 200 may be used with the insert system 10, and that the scope of the insert system 10 is not limited in any way by the type(s) of flavor releasing mechanism(s) 200 used.

Flavor Mechanism Holder 300

Figure 35:
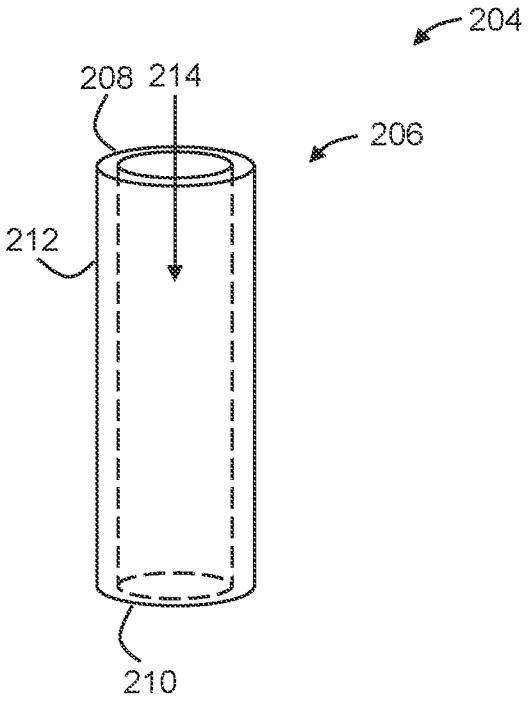
FIG. 35 shows aspects of a holder according to exemplary embodiments hereof.
Figure 36:
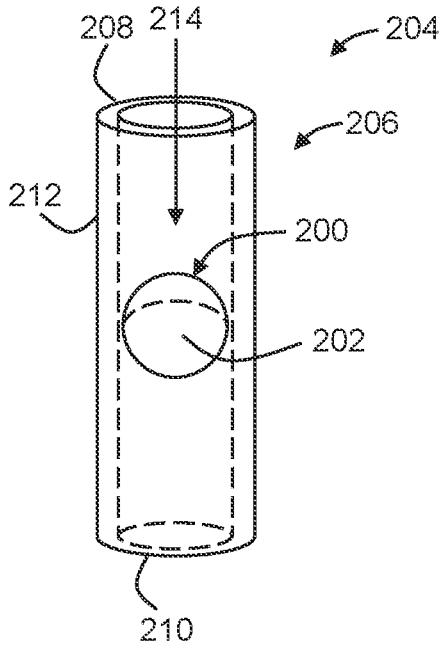
FIGS. 36-37 show aspects of a flavor releasing mechanism within a holder according to exemplary embodiments hereof.
Figure 37:
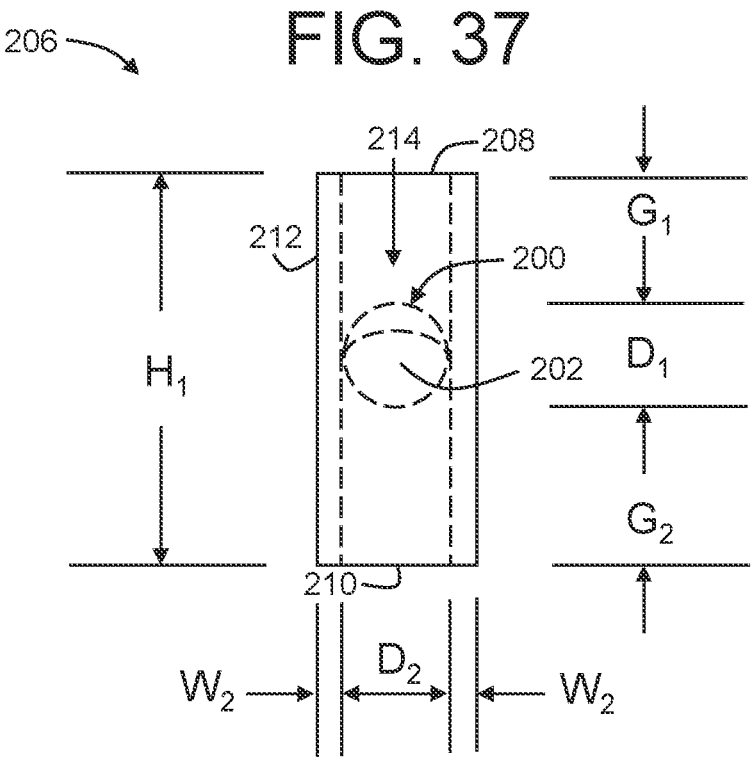

In some embodiments, as shown in FIGS. 35-37, the flavor mechanism holder element 204 (also referred to as simply the holder 204) is designed to receive and generally surround and hold the flavor releasing mechanism 200. In some embodiments, the holder 204 may be optional. For example, the holder element 204 may not be included in the embodiment of FIG. 3, and as such, the area within the member's inner volume 110 in which the flavor releasing mechanism 200 may be located may be larger than if a holder 204 were included, thereby enabling the flavor releasing mechanism 200 to be larger as well.

In some embodiments, as shown in FIGS. 35-37, the holder element 204 includes a generally tubular structure 206 including a first end 208 (e.g., a top end), a second end 210 (e.g., a bottom end), and sidewalls 212 extending from the first end 208 to the second end 210. Being generally tubular, the holder element 204 includes a hollow inner passageway 214 extending between the first end 208 and the second end 210.

In some embodiments, the holder 204 and the inner passageway 214 include generally circular cross-sections. However, it is understood that the holder 204 may include other shapes (e.g., frustum shaped), with other shaped cross sections (e.g., oval) and any combinations thereof. It also is understood that the inner passageway 214 may include other shapes (e.g., may be frustum shaped) and that the cross section of the inner passageway 214 may be circular, rectangular, oval, polygonal, formed as other shapes, and any combination thereof.

In some embodiments, the tubular structure 206 includes a slot in the sidewalls 212 extending from its first end 208 to the second end 210. This may result from the holder 204 being formed of a section of material (e.g., a rectangular section of holder material) rolled into a tubular form during the manufacturing process. However, in other embodiments, the slot may not be formed or provided.

In some embodiments, the holder 204 comprises a compressible and/or elastic material. In some embodiments, the holder 204 is compressible so that the holder 204 may be squeezed using normal human strength to deflect the side walls 212 inward. This deflection may in turn compress a flavor mechanism 200 held within the holder 204 so that the flavor mechanism 200 may burst or otherwise open and release flavor as described in other sections. Upon release of the holder 204, the holder 204 may preferably return to its original shape.

In some embodiments, the holder 204 comprises a polymer. In some embodiments, the holder 204 includes silicone (e.g., preferably food grade silicone). In other embodiments, the holder 204 comprises rubber, plastic, other types of polymers, paper, cotton, cellulose acetate, a gelatinous substance (e.g., gelatin or other gelatinous substances), foam, webbing, plant material(s) (e.g., leaf material), wood, other compressible materials, and any combinations thereof.

In some embodiments, the holder 204 may be solid, porous, and any combinations thereof.

In some embodiments, as shown in FIGS. 36 and 37, the holder 204 is designed to receive and secure a flavor mechanism 200 within its structure, e.g., within its hollow inner passageway 214. FIG. 36 shows a schematic of the holder 204 including a flavor mechanism 200 and FIG. 37 shows a side sectional view of the same. In some embodiments, the width or diameter $D_2$ of the inner passageway 214 preferably matches the width or diameter $D_1$ of the flavor mechanism 200. In this way, the flavor mechanism 200 may be held within the holder 204 (within the inner passageway 214) by pressure fit and/or friction between the flavor mechanism 200 and the inner side walls of the inner passageway 214.

In some embodiments, the width or diameter $D_2$ of the inner passageway 214 may be chosen to be slightly less than the width or diameter $D_1$ of the flavor mechanism 200. In this way, the inner passageway 214 may expand upon receiving the flavor mechanism 200 (the holder 204 comprising a compressible material) to accommodate the mechanism's 200's slightly wider width $D_1$. Given this, the flavor mechanism 200 may be held within the holder 204 (within the inner passageway 214) by friction between the flavor mechanism 200 and the inner side walls of the inner passageway 214, the friction being increased by the compressive force applied to the flavor mechanism 200 by the expanded inner passageway 214.

In some embodiments, as shown in FIG. 37, the flavor mechanism 200 is located within the inner passageway 214 between the first end 208 and the second end 210, and preferably about midway between the first end 208 and the second end 210. In some embodiments, the height H, of the holder 204 is greater than the diameter $D_1$ of the flavor mechanism 200 so that a first gap $G_1$ exists between the first end 208 and the flavor mechanism 200, and a second gap $G_2$ exists between the second end 210 and the flavor mechanism 200. In this way, no elements of the insert system 10 come into physical contact with the flavor releasing mechanism 200 except for the flavor mechanism holder 204 (due to the gaps $G_1$, $G_2$ separating the flavor mechanism 200 from any elements outside the holder 204). In other words, the flavor mechanism 200 fits entirely within the inner passageway 214.

In some embodiments, as shown in FIG. 37, the overall diameter of the holder 204 is equal to the diameter $D_2$ of the inner passageway 310 plus twice the width W2 of the holder body's side walls 212. As will be described in other sections, it may be preferable that the diameter of the holder 204 be less than the diameter of the insert body member 102 so that the holder 204 may fit within the inner volume 110 of the body member 102 as described herein.

It is understood that more than one flavor releasing mechanism 200 may be placed within a flavor mechanism holder 204 with gaps $G_1$, $G_2$ existing between the flavor releasing mechanisms 200 and the ends 208, 210 of the holder 204. In this way, an insert system 10 including two or more flavor releasing mechanisms 200 may be formed.

It is understood that the actions described above to form an insert system 10 using a section 300, a flavor releasing mechanism 200, and optionally, a flavor mechanism holder 204 are meant for demonstration and that the method of forming the insert system 10 may include other actions not necessarily described, may not include all of the actions described, and/or any combinations thereof. In addition, the actions may be performed in a different order.

Figure 38:
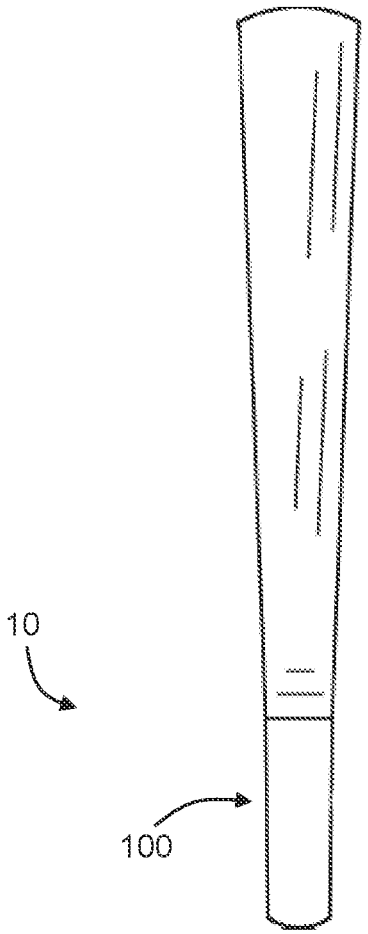
FIG. 38 shows aspects of an insert system configured with a smokable item according to exemplary embodiments hereof.

In some embodiments as shown in FIG. 38, once the insert system 10 has been formed as described above or otherwise, it may be used as a tip, a mouthpiece, a crutch, a filter, as any type of base for a pre-roll, cone, empty cone, cigarette, other type of smokable, and for any combinations thereof as known in the art or otherwise. For example, in some embodiments, the insert system 10 may be provided to manufacturers of pre-roll cones and/or cigarettes, of empty cones, etc. to be coupled to these types of products and then sold to consumers. In another example, the insert system 10 may be coupled with a pre-roll cone and/or cigarette, and/or to an empty cone during its manufacturing and made for sale to consumers as the combination. In another example, the insert system 10 may be sold directly to consumers such that the consumers themselves may couple the insert system 10 with a rolling paper to form a cigarette, a cone, an empty cone, or other type of smokable item. It is understood that the examples described above are meant for demonstration and are non-limiting.

It is understood that any details and/or aspects of any embodiments of the system 10 described herein may be combined with any details and/or aspects of any other embodiments of the system 10 in any way to form additional embodiment(s) of the system 10 all of which are within the scope of the insert system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A smokable item comprising:

a section of material including a top edge, a bottom edge, a first side edge extending between the top edge and the bottom edge, and a second side edge opposite the first side edge and extending between the top edge and the bottom edge, the top edge and the second side edge converging to form a first corner portion, the bottom edge and the second side edge converging to form a second corner portion, a cutout area formed by removing the first corner portion, the second corner portion folded towards the first side edge to form a partition portion, a first portion of the section of material rolled about the partition portion and about the first cutout area to form a rolled section of material with an inner volume and with the partition portion extending through the inner volume from the bottom edge to the first cutout area, and the first cutout area extending from an end of the partition portion to the top edge;

a flavor releasing mechanism within the inner volume in the cutout area, the flavor releasing mechanism including a hollow shell filled with a flavoring substance;

a combustible elongate member including a mouth end and a lighting end opposite the mouth end, the top edge coupled proximal to the mouth end such that the bottom edge is located distal from the mouth end.

2. The smokable item of claim 1 further comprising an obstructor in the cutout area within the inner volume and located between the partition portion and the top edge.

3. The smokable item of claim 2 wherein the obstructor and the partition portion are located on opposite sides of the flavor releasing mechanism.

4. The smokable item of claim 2 wherein the obstructor comprises an obstructor material separate from the section of material.

5. The smokable item of claim 2 wherein the obstructor is held within the inner volume solely by pressure fit.

6. The smokable item of claim 1 wherein the partition portion comprises a single linear segment of the section of material that extends continually across the inner volume.

7. The smokable item of claim 1 wherein the partition portion separates the inner volume into two elongate compartments.

8. The smokable item of claim 1 further comprising a flavor releasing mechanism holder comprising a tubular structure with a hollow passageway and the hollow shell filled with a flavoring substance is located within the hollow passageway.

9. A method of forming a smokable item comprising:

(A) providing a section of material including a top edge, a bottom edge, a first side edge extending between the top edge and the bottom edge, and a second side edge opposite the first side edge and extending between the top edge and the bottom edge, the top edge and the second side edge converging to form a first corner portion, and the bottom edge and the second side edge converging to form a second corner portion;

(B) removing the first corner portion to form a first cutout area in the section of material;

(C) folding the second corner portion towards the first side edge to form a partition portion;

(D) rolling a first portion the first section of material about the partition portion and about the first cutout area to form a rolled section of material with an inner volume, the partition portion extending through the inner volume from the bottom edge to the first cutout area and the first cutout area extending from an end of the partition portion to the top edge;

(E) placing a flavor releasing mechanism into the inner volume in the cutout area, the flavor releasing mechanism including a hollow shell filled with a flavoring substance;

(F) providing a combustible elongate member including a mouth end and a lighting end opposite the mouth end;

(G) coupling the top edge proximal to the mouth end of the combustible elongate member such that the bottom edge is located distal from the mouth end.

10. The method of claim 9 further comprising:

(E) (1) providing a flavor releasing mechanism holder comprising a tubular structure with a hollow passageway;

(E) (2) placing the hollow shell filled with a flavoring substance into the hollow passageway.

11. The method of claim 9 wherein the removing the first corner portion in (B) includes at least one of cutting the first corner portion and folding the first corner portion.

* * * * *